US007852018B2

(12) United States Patent
Ahn et al.

(10) Patent No.: US 7,852,018 B2
(45) Date of Patent: Dec. 14, 2010

(54) APPARATUS AND METHOD OF DRIVING LAMP OF LIQUID CRYSTAL DISPLAY DEVICE

(75) Inventors: In Ho Ahn, Daegu (KR); Pu Jin Kim, Gumi-si (KR); Jae Hun Song, Seoul (KR); Chang Ho Lee, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 341 days.

(21) Appl. No.: 12/230,181

(22) Filed: Aug. 25, 2008

(65) Prior Publication Data

US 2009/0128051 A1 May 21, 2009

Related U.S. Application Data

(62) Division of application No. 11/157,836, filed on Jun. 22, 2005, now Pat. No. 7,417,383.

(30) Foreign Application Priority Data

Jun. 28, 2004 (KR) ..... 10-2004-049024

(51) Int. Cl.
*H05B 37/02* (2006.01)

(52) U.S. Cl. ..... 315/299; 315/220; 315/226; 315/255; 315/277; 315/320; 315/360; 315/DIG. 4

(58) Field of Classification Search ..... 315/209 R, 315/210, 220, 224, 225, 226, 246, 250, 255, 315/276, 277, 291, 299, 307, 312, 324, 320, 315/360, DIG. 2, DIG. 4, DIG. 5, DIG. 7
See application file for complete search history.

(56) References Cited

U.S. PATENT DOCUMENTS 6,316,881 B1 * 11/2001 Shannon et al. ..... 315/219
6,339,298 B1 * 1/2002 Chen ..... 315/224
7,443,107 B2 * 10/2008 Shannon et al. ..... 315/224

* cited by examiner

*Primary Examiner*—Thuy Vinh Tran
(74) *Attorney, Agent, or Firm*—McKenna Long & Aldridge

(57) ABSTRACT

A method of driving a lamp of a liquid crystal display device includes generating a control signal; generating a first drive signal using the control signal; generating a second drive signal by shifting a voltage level of the first drive signal; selectively outputting one of a high potential supply voltage and a low potential supply voltage in response to the second drive signal; transforming the selectively outputted voltage; and supplying the transformed voltage to a lamp.

7 Claims, 17 Drawing Sheets

(a)

(b)

APPARATUS AND METHOD OF DRIVING LAMP OF LIQUID CRYSTAL DISPLAY DEVICE

This application is a Divisional of prior application Ser. No. 11/157,836, filed Jun. 22, 2005 now U.S. Pat. No. 7,417,383, which claims the benefit of Korean Patent Application No. 10-2004-049024 filed in Korea on Jun. 28, 2004, which is hereby incorporated by reference in its entirety as if fully set forth herein.

BACKGROUND OF THE INVENTION

1. Field of the Invention

The present invention relates to a liquid crystal display device, and more particularly to an apparatus and a method of driving a lamp of a liquid crystal display device.

2. Description of the Related Art

Generally, liquid crystal display devices ("LCD") are being widely used because they are light, thin, and consumes low power. For example, liquid crystal display devices are used in office automation equipment, and audio/video equipment. A liquid crystal display (LCD) controls the light transmittance of liquid crystal using an electric field in accordance with a video signal applied to a plurality of control switches which are arranged in a matrix, to thereby display a picture. To this end, the LCD includes a liquid crystal display panel having a pixel matrix, and a driving circuit for driving the liquid crystal display panel. The driving circuit drives the pixel matrix such that picture information can be displayed on the display panel.

Such a LCD is not a self-luminous display device, because it requires an additional light source like a backlight unit. A cold cathode fluorescent tube (hereinafter, referred to as "CCFT") is used as the light source in the backlight unit. The CCFL is a light source tube using a cold emission phenomenon. In the cold emission phenomenon, an electron emission is generated by a strong electric field applied to a cathode surface. The CCFL generates low heat, is very bright, and has a long life span and full color capability. The CCFL can be used in a light guide type light source, a direct light type light source, and a reflector type light source. An appropriate type of light source tube is selected according to the requirement of the liquid crystal display device. The CCFL uses an inverter circuit for obtaining a high voltage power from a DC power source of low voltage.

FIG. 1 a diagram representing a lamp driving apparatus of a liquid crystal display device according to the related art. Referring to FIG. 1, the related lamp driving apparatus includes a plurality of lamps 6 which generate light; a plurality of inverter parts 4 to drive the lamps 6 by supplying an AC waveform of high voltage to the lamps 6; and an inverter controller 2 to control the inverter parts 4. The lamps 6 receive a lamp output voltage from the inverter parts 4 and irradiate a visible light onto a liquid crystal display panel (not shown). Each of the lamps 6 is composed of a glass tube. The glass tube is filled with an inert gas, and a phosphorus is spread over the inner wall of the glass tube. A high AC voltage is applied by the inverter 4 to a high voltage electrode of each of the lamps 6. Electrons are emitted in each of the lamps 6 and collide with the inert gas, thereby increasing the number of electrons according to a geometric progression. The abundance of electrons causes an electrical current to flow in the glass tube. Thus, the inert gas, such as Ar and Ne, is excited by the electrons to generate energy. The generated energy excites mercury to emit an ultraviolet ray. The ultraviolet ray collides with the luminous phosphorus, which is spread over the inner wall of the glass tube, to emit a visible ray.

FIG. 2 is a diagram representing the related art inverter part shown in FIG. 1. Referring to FIG. 2, each of the inverter parts 4 is driven by an enable signal ENA from the inverter controller 2 (shown in FIG. 1), drives the lamps 6 using a clock signal CLK and a reference voltage Vref from the inverter controller 2, and transmits to the inverter controller 2 a state signal ACK generated when a malfunction occurs in the lamp 6. Accordingly, if the state signal ACK is supplied to the inverter controller 2, the inverter controller 2 stops driving the inverter part 4 corresponding to the lamp 6 where the malfunction occurs. Each of the inverter parts 4 includes an inverter 8, a switch device 16 and transformer 18. The transformer 18 supplies a high voltage to the lamps 6. The switch device part 16 supplies an externally provided DC power source VDD to the transformer 18 in accordance with the output value of the inverter 8. The inverter 8 drives the switch device part 16.

The transformer 18 includes a primary winding T1 of which both ends are connected to the switch device part 16, a first winding of secondary winding T2 to which a high voltage AC waveform having a first phase is induced by a winding ratio with the primary winding T1, and a second winding of secondary winding T3 to which a high voltage AC waveform having a second phase is induced by the winding ratio with the primary winding T1. One side of the first winding of secondary winding T2 is connected to one side of the lamp 6, and the other side is connected to a feedback circuit 14. One side of the second winding of secondary winding T3 is connected to the other side of the lamp 6, and the other side is connected to the feedback circuit 14. An AC waveform supplied from the switch device 16 is converted into the high voltage AC waveform induced in the first winding of secondary winding T2 of the transformer 18. The AC waveform supplied from the switch device 16 to the primary winding T1 is converted into the high voltage AC waveform induced in the second winding of secondary winding T3 of the transformer 18. The current supplied by the high voltage AC waveform induced in the first winding of secondary winding T2 and the second winding of secondary winding T3 of the transformer 18 is supplied to each of the lamps 6. Accordingly, the lamps 6 are discharged by the current supplied by the high voltage AC waveforms to generate the light.

The inverter 8 uses the clock signal CLK and the reference voltage Vref supplied from the inverter controller 2 to generate drive signals PDR1, NDR1, PDR2, and NDR2 to drive the switch device part 16. The inverter 8 includes a drive signal generator 10 to drive the switch device part 16, a feedback circuit 14 connected to the transformer 18 to detect the output voltage of the transformer 18, and a switch controller 12 to generate a control signal SCS for controlling the switch device part 16 based on a feedback signal FB from the feedback circuit 14 to the switch controller 12.

The feedback-circuit 14 generates the feedback signal FB corresponding to the high voltage AC waveforms FB1 and FB2 from the first winding of secondary winding T2 and the second winding of secondary winding T3 of the transformer 18. The feedback circuit 14 supplies the generated feedback signal FB to the switch controller 12.

FIG. 3 is a diagram representing a method of calculating a pulse width of a dimming signal in accordance with the related art. Referring to FIGS. 2 and 3, the switch controller 12 generates a switching control signal SCS using a triangular wave current LCT which is induced to the primary winding T1 of the transformer 18 and a dimming voltage Vdim of DC for controlling the brightness of the lamp 6, in accordance with the feedback signal FB from the feedback signal 14. The amplitude of the dimming voltage Vdim changes in accordance with the feedback signal FB. For example, the dimming voltage Vdim decreases to the lower part of the triangular wave current LCT which is induced to the primary winding T1 of the transformer 18 when the brightness of the light generated at the lamp 6 is low, and the dimming voltage Vdim increases to the upper part of the triangular wave current LCT when the brightness of the light generated at the lamp 6 is high. The generated switching control signal SCS is supplied to the drive signal generator 10.

FIG. 4 is a diagram representing drive signals supplied to the related art switch device part shown in FIG. 1. The drive signal generator 10 generates the drive signals PDR1, NDR1, PDR2, and NDR2 shown in FIG. 4 in accordance with the reference voltage Vref supplied from the inverter controller 2 and the switching control signal SCS supplied from the switch controller 12. The drive signal generator 10 supplies the drive signals PDR1, NDR1, PDR2, and NDR2 to the switch device part 16.

The switch device part 16 is driven in accordance with the drive signals PDR1, NDR1, PDR2, and PDR2 supplied from the drive signal generator 10 to supply the externally provided DC power VDD to the primary winding T1 of the transformer 18. The switch device part 16 includes a first switch part 16*a* for supplying a positive (+) DC voltage to the primary winding T1 of the transformer 18 and a second switch part 16*b* for supplying a negative (−) DC voltage to the primary-winding T1 of the transformer 18. The first switch part 16*a* supplies the positive (+) DC voltage VDD to both terminals "a" and "b" of the primary winding T1 of the transformer 18. The first switch part 16*a* includes a first switch device Q1 installed between a first terminal of the primary winding T1 of the transformer 18 and the DC voltage source VDD to be driven by the first drive signal PDR1 supplied from the drive signal generator 10; and a second switch device Q2 installed between a ground voltage source GND and the first terminal of the primary winding T1 of the transformer 18 to be driven by the second drive signal NDR1 supplied from the drive signal generator 10. The first switch device Q1 is a P-type transistor (MOSFET or BJT) and the second switch device Q2 is an N-type transistor (MOSFET or BJT). If the first and second drive signals PDR1 and NDR1 shown in FIG. 4 are supplied, the first and second switching devices Q1, Q2 supply the DC voltage VDD to the first terminal of the primary winding T1 of the transformer 18 when the first and second drive signals PDR1, NDR1 are low.

The second switch part 16*b* supplies the negative (−) DC voltage VDD to both terminals "a" and "b" of the primary winding T1 of the transformer 18. The second switch part 16*b* includes a third switch device Q3 installed between a second terminal of the primary winding T1 of the transformer 18 and the DC voltage source VDD to be driven by the third drive signal PDR2 supplied from the drive signal generator 10; and a fourth switch device Q4 installed between a ground voltage source GND and the second terminal of the primary winding T1 of the transformer 18 to be driven by the fourth drive signal NDR2 supplied from the drive signal generator 10. The third switch device Q3 is a P-type transistor (MOSFET or BJT) and the second switch device Q4 is an N-type transistor (MOSFET or BJT). When the third and fourth drive signals PDR2 and NDR2 shown in FIG. 4 are supplied, the third and fourth switching devices Q3 and Q4 supply the DC voltage VDD to the second terminal of the primary winding T1 of the transformer 18 when the third and fourth drive signals PDR2 and NDR2 are low.

FIG. 5 is a diagram representing a voltage supplied to a primary winding of a transformer by the drive signals shown in FIG. 4. As shown in part of (a) of FIG. 5, a first DC voltage VoutH is supplied to one side of the primary winding T1 of the transformer 18. However, the DC voltage VoutH is not supplied to the first terminal of the primary winding T1 of the transformer 18 when the first and second drive signals PDR1 and NDR1 are high. As shown in part (b) of FIG. 5, a second DC voltage VoutL is supplied to the second terminal of the primary winding T1 of the transformer 18. However, the second DC voltage VoutL is not supplied to second terminal of the primary winding T1 of the transformer 18 when the third and fourth drive signals PDR2 and NDR2 are high. A tank voltage VL shown in part (c) of FIG. 5 is generated across terminals "a" and "b" of the primary winding T1 of the transformer 18 by the first and second switch parts 16*a* and 16*b*. As shown in FIG. 3, the tank voltage causes a triangular wave current LCT to be induced in the primary winding T1 of the transformer 18.

FIG. 6 is a diagram representing dimming signals generated by the related art inverter controller shown in FIG. 1. Referring to FIGS. 1 and 6, the inverter controller 2 receives a polarity control signal POL for controlling the polarity of a dimming signal and an inverter selection signal SEL from a system (not shown). The inverter controller 2 supplies to the inverter part 4 dimming signals L0 to L11 for controlling the brightness of light generated by the lamps 6, an enable signal ENA for driving the inverter part 4, and a clock signal CLK and the reference voltage Vref for generating the drive signals PDR1, NDR1, PDR2, and NDR2. When a state signal ACK indicating a malfunction in one of the lamps 6 is received from one of the inverters parts 4, the inverter controller 2 stops driving the inverter part 4 corresponding to the lamp 6 where a malfunction occurs. Further, the inverter controller 2 supplies to the inverter part 4 the dimming signals L0 to L11 generated by an external vertical synchronization signal Vsync having a period T2, as shown in FIG. 6. The inverter 4 controls the brightness of the light generated by the lamps 6. As shown in FIG. 3, the width of each of the dimming signals L0 to L11 is controlled by a signal having a period T1 which is formed by the triangular wave current LCT induced between the terminals "a" and "b" of the primary winding T1 of the transformer 18 and the dimming voltage Vdim of DC.

However, the related art lamp driving apparatus of the liquid crystal display device increases the cost of the liquid crystal display device because the lamps 6 are driven by the plurality of inverter parts 4.

SUMMARY OF THE INVENTION

Accordingly, the present invention is directed to an apparatus and a method of driving a lamp of a liquid crystal display device that substantially obviate one or more of the problems due to limitations and disadvantages of the related art.

An object of the present invention to provide an apparatus and a method of driving a lamp of a liquid crystal display device that reduce cost.

To achieve these objects and other advantages and in accordance with the purpose of the present invention, as embodied and broadly described herein, a lamp driving apparatus of a liquid crystal display device includes a plurality of lamps; a polarity signal generator that generates a polarity signal; an inverter that generates a first drive signal; an inverter controller that drives the inverter and generates a first dimming signal, the polarity of the first dimming signal being determined by the polarity signal; a first level shifter that generates a second dimming signal by shifting a voltage level of the first dimming signal; a second level shifter that generates a second drive signal by shifting a voltage level of the first drive signal;

a plurality of logical sum gate parts, each of the plurality of logical sum gate parts generating a third drive signal by performing a logical sum of the second dimming signal and the second drive signal; a plurality of switch device parts, each of the plurality of switch device parts receiving a high potential supply voltage and a low potential supply voltage and selectively outputting one of the high potential supply voltage and the low potential supply voltage in response to the third drive signal; and a plurality of transformers, each of the plurality of transformers transforming the selectively outputted voltage of the switch device parts and supplying the transformed voltage to the lamps.

In another aspect, a lamp driving apparatus of a liquid crystal display device includes a polarity signal generator to generate a polarity signal; an inverter that generates a first drive signal; an inverter controller that drives the inverter and generates a first dimming signal, the polarity of the first dimming signal being determined by the polarity signal; a first level shifter that generates a second dimming signal by shifting a voltage level of the first dimming signal; a dead time tuning part that generates a second drive signal by delaying a dead time of the first drive signal; a plurality of logical sum gate parts, each of the plurality of logical sum gate parts generating a third drive signal by performing a logical sum of the second dimming signal and the second drive signal; a level shifter part that generates a fourth drive signal by shifting a voltage level of the third drive signal; a plurality of switch device parts, each of the plurality of switch device parts receiving a high potential supply voltage and a low potential supply voltage and selectively outputting one of the high potential supply voltage and the low potential supply voltage in response to the fourth drive signal; and a plurality of transformers, each of the plurality of transformers transforming the selectively outputted voltage of the switch device parts and supplying the transformed voltage to the lamps.

In another aspect, a lamp driving apparatus of a liquid crystal display device includes a plurality of lamps; an inverter that generates a first drive signal; an inverter controller that drives the inverter and supplies a control signal for supplying the first drive signal to the inverter; a plurality of level shifters, each of the plurality of level shifters generating a second drive signal by shifting a voltage level of the first drive signal; a plurality of switch device parts, each of the plurality of switch device parts receiving a high potential supply voltage and a low potential supply voltage and selectively outputting one of the high potential supply voltage and the low potential supply voltage in response to the second drive signal; a plurality of transformers, each of the plurality of transformers transforming the selectively outputted voltage of the switch device parts and supplying the transformed voltage to the lamps.

In another aspect, a method of driving a lamp of a liquid crystal display device, includes generating a polarity signal; generating a first drive signal in response to the polarity signal; generating a first dimming signal, the polarity of the first dimming signal being determined by the polarity signal; generating a second dimming signal by shifting a voltage level of the first dimming signal; generating a second drive signal by shifting a voltage level of the first drive signal; generating a third drive signal by logically summing the second dimming signal and the second drive signal; selectively outputting one of a high potential supply voltage and a low potential supply voltage in response to the third drive signal; transforming the selectively outputted voltage; and supplying the transformed voltage to a lamp.

In another aspect, a method of driving a lamp of a liquid crystal display device includes generating a polarity signal; generating a first drive signal in response to the polarity signal; generating a first dimming signal, the polarity of the first dimming signal being determined by the polarity signal; generating a second dimming signal by shifting a voltage level of the first dimming signal; generating a second drive signal by delaying a dead time of the first drive signal; generating a third drive signal by logically summing the second dimming signal and the second drive signal; generating a fourth drive signal by shifting a voltage level of the third drive signal; selectively outputting one of a high potential supply voltage and a low potential supply voltage in response to the third drive signal; transforming the selectively outputted voltage; and supplying the transformed voltage to a lamp.

In another aspect, a method of driving a lamp of a liquid crystal display device includes generating a control signal; generating a first drive signal using the control signal; generating a second drive signal by shifting a voltage level of the first drive signal; selectively outputting one of a high potential supply voltage and a low potential supply voltage in response to the second drive signal; transforming the selectively outputted voltage; and supplying the transformed voltage to a lamp.

In another aspect, a lamp driving apparatus of a liquid crystal display device includes a plurality of lamps; a first level shifter generating a second dimming signal by shifting a voltage level of a first dimming signal; a second level shifter generating a second drive signal by shifting a voltage level of a first drive signal; a plurality of logical sum gate parts, each of the plurality of logical sum gate parts generating a third drive signal by performing a logical sum of the second dimming signal and the second drive signal; a plurality of switch device parts, each of the plurality of switch device parts selectively outputting one of a high potential supply voltage and a low potential supply voltage in response to the third drive signal; and a plurality of transformers, each of the plurality of transformers transforming the selectively outputted voltage of the switch device parts and supplying the transformed voltage to the lamps.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

DETAILED DESCRIPTION OF THE PREFERRED EMBODIMENTS

Reference will now be made in detail to the preferred embodiments of the present invention, examples of which are illustrated in the accompanying drawings.

Figure 1:
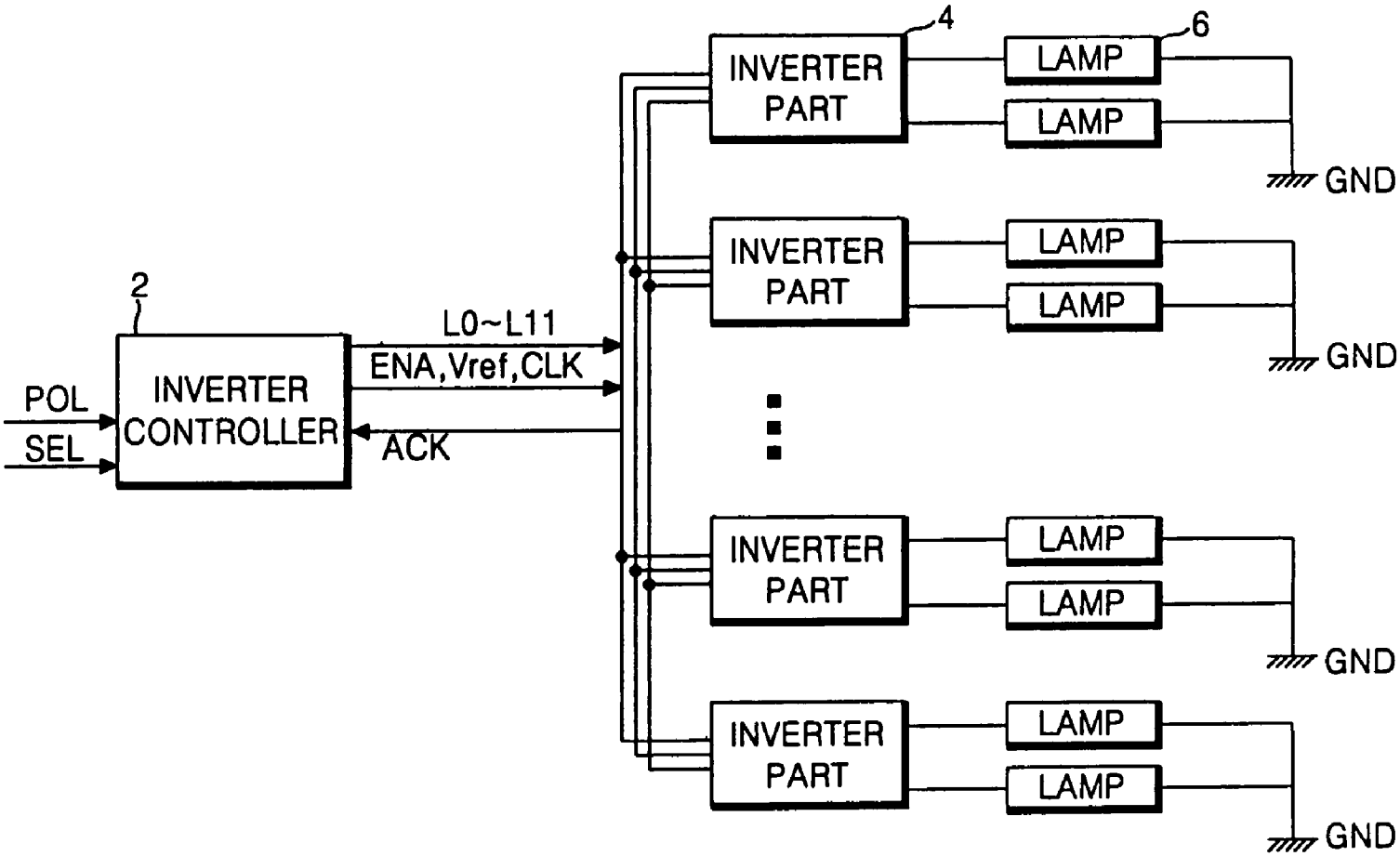
FIG. 1 RELATED ART
FIG. 1 a diagram representing a lamp driving apparatus of a liquid crystal display device according to the related art.
Figure 2:
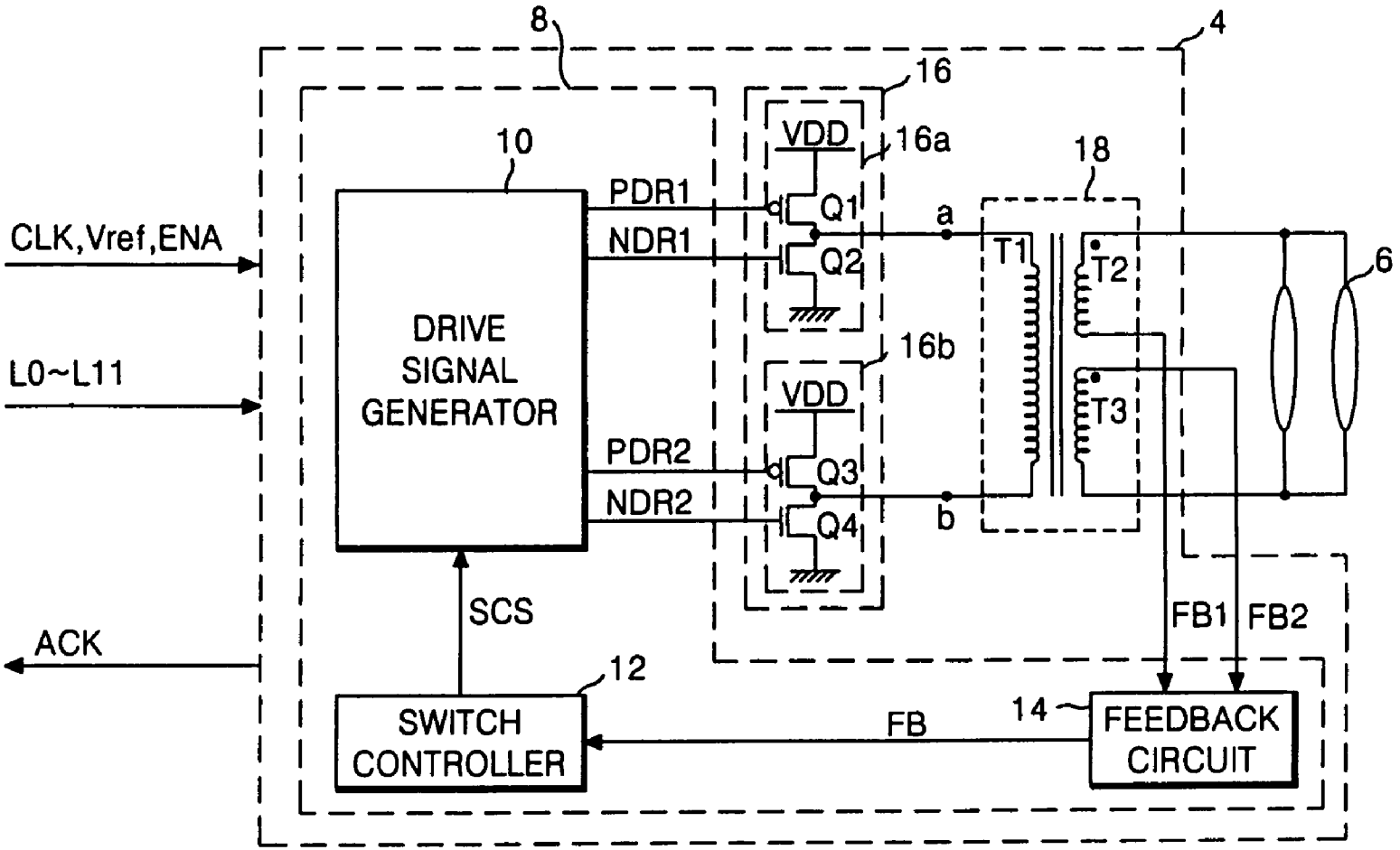
FIG.2 RELATED ART
FIG. 2 is a diagram representing the related art inverter part shown in FIG. 1.
Figure 3:
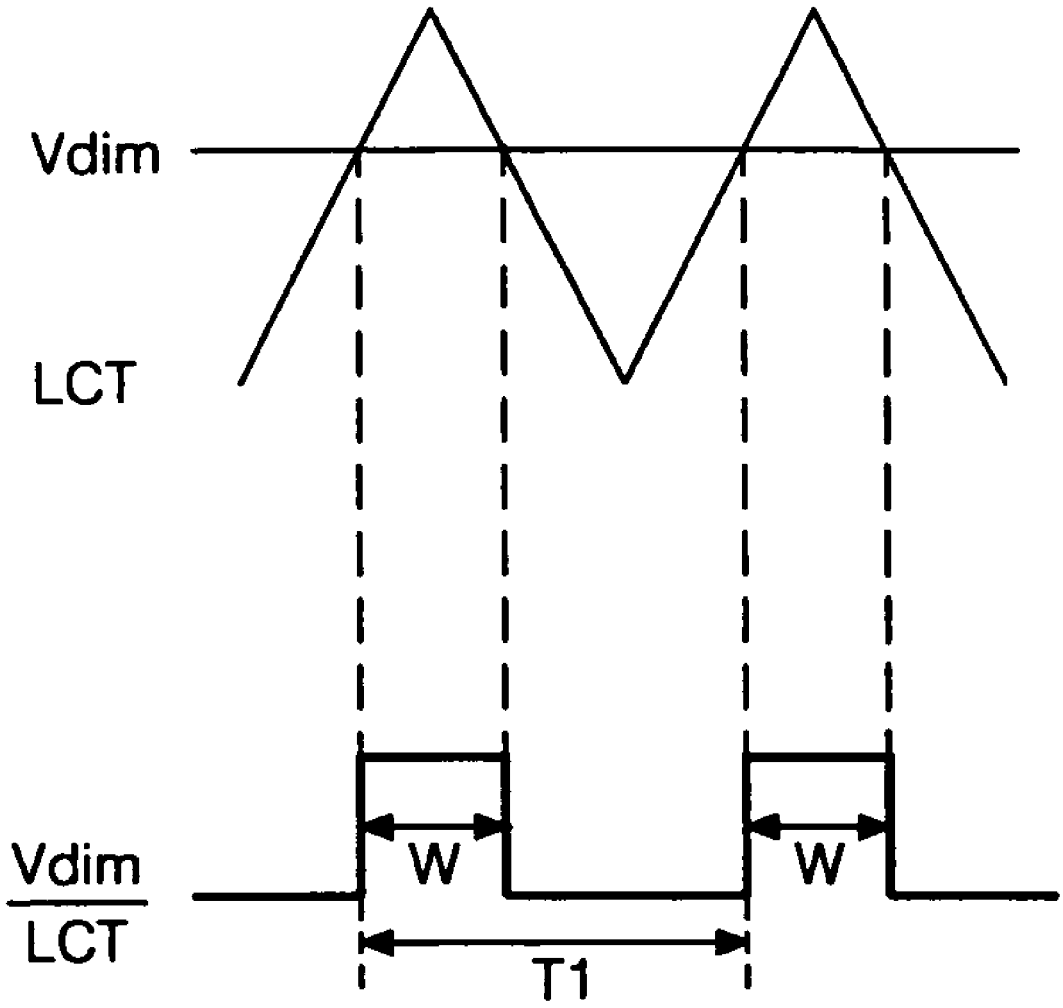
FIG. 3 RELATED ART
FIG. 3 is a diagram representing a method of calculating a pulse width of a dimming signal in accordance with the related art.
Figure 4:
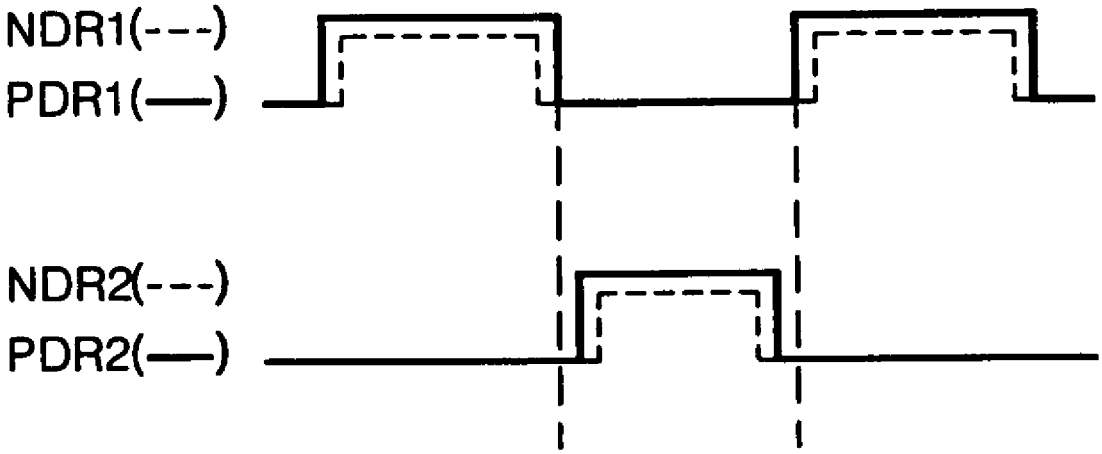
FIG. 4 RELATED ART
FIG. 4 is a diagram representing drive signals supplied to the related art switch device part shown in FIG. 1.
Figure 5:
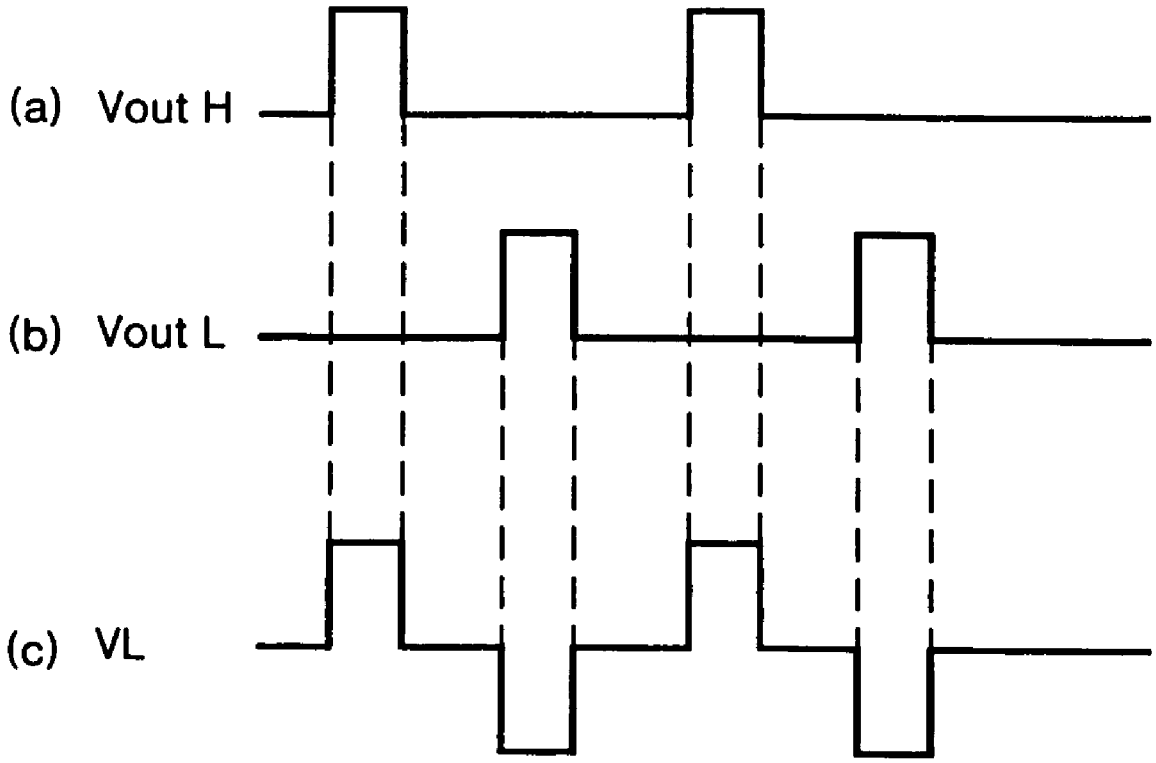
FIG. 5 RELATED ART
FIG. 5 is a diagram representing a voltage supplied to a primary winding of a transformer by the drive signals shown in FIG. 4.
Figure 6:
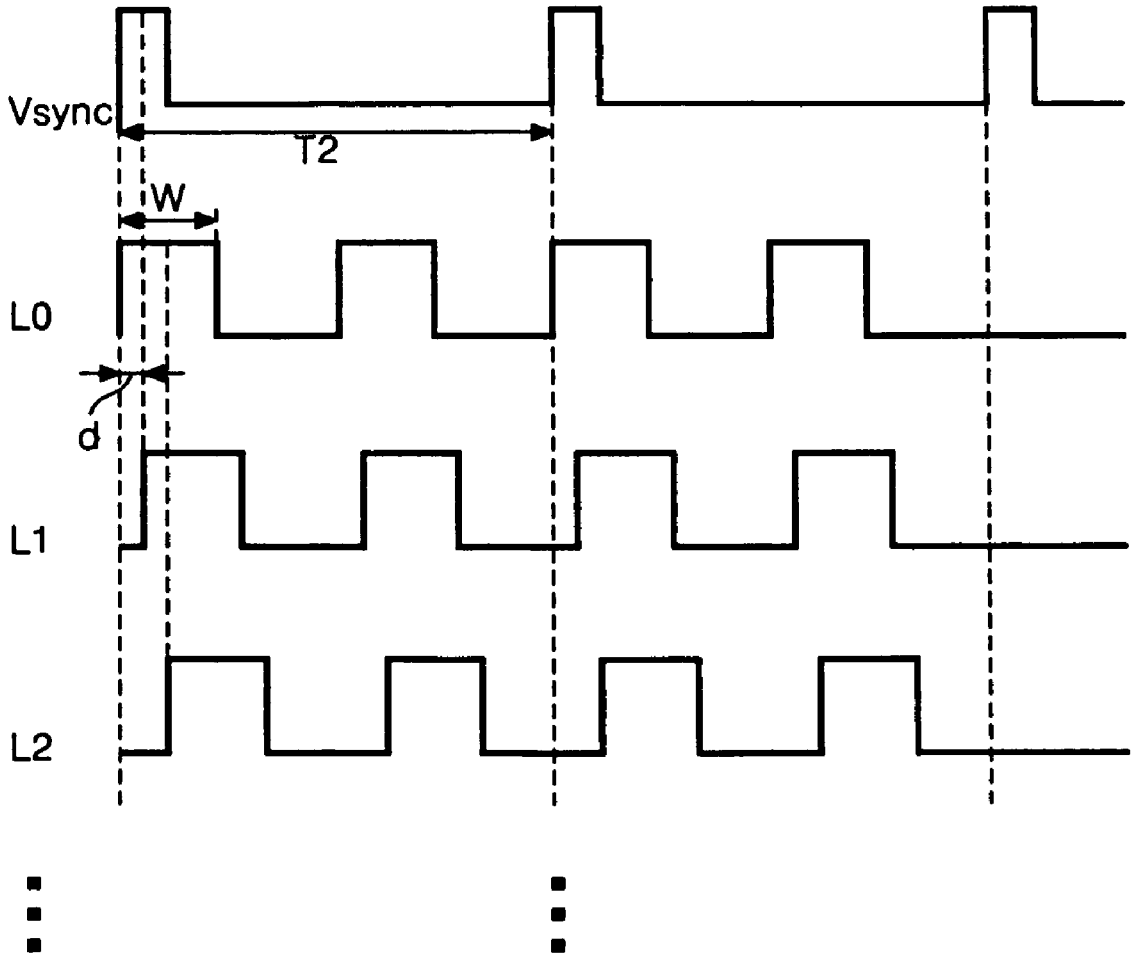
FIG. 6 RELATED ART
FIG. 6 is a diagram representing dimming signals generated by the related art inverter controller shown in FIG. 1.
Figure 7:
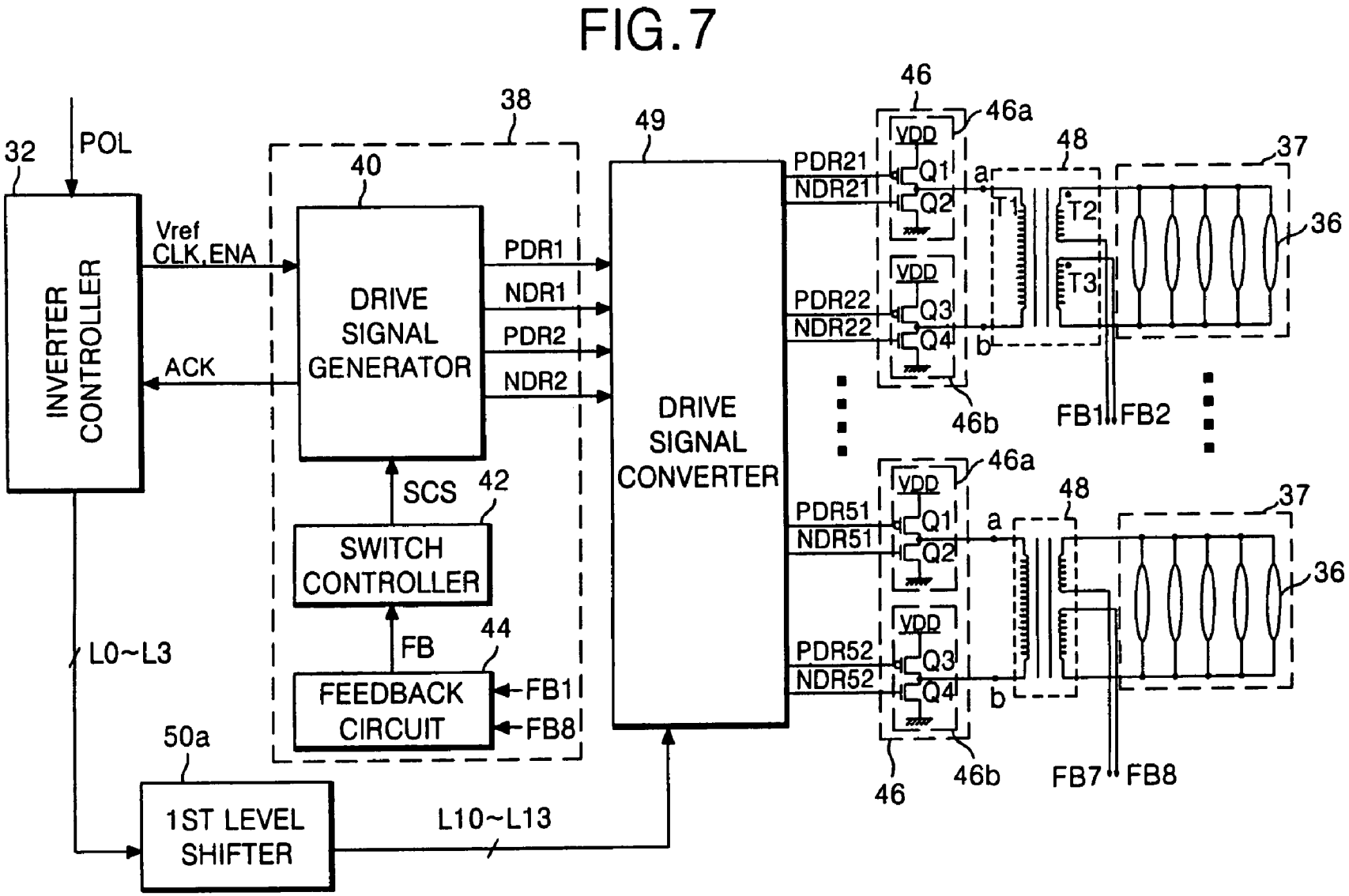
FIG. 7 is a diagram of an exemplary lamp driving apparatus of a liquid crystal display device according to a first embodiment of the present invention.
Figure 8:
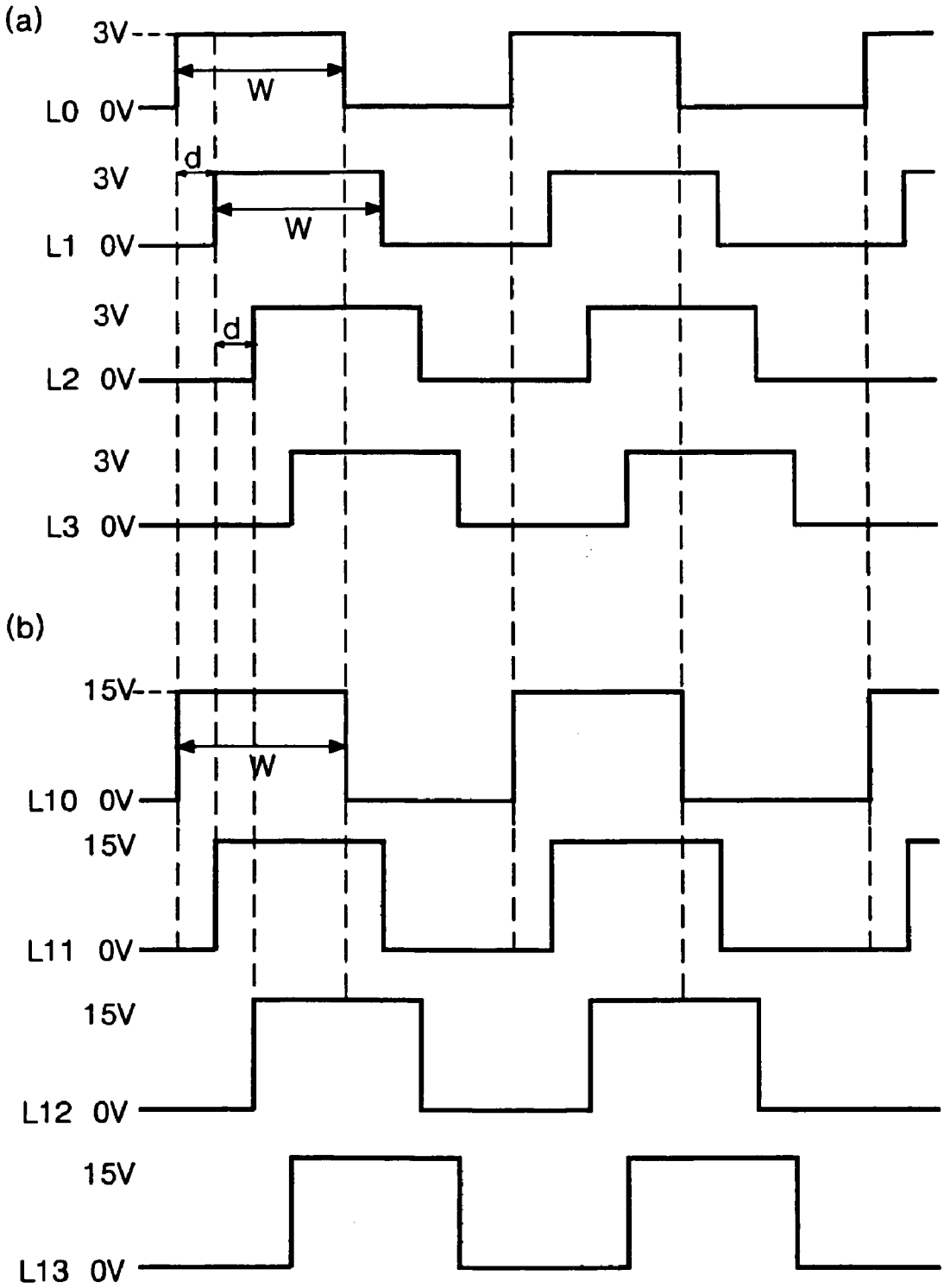
FIG. 8 is a waveform diagram representing exemplary dimming signals generated in the lamp driving apparatus of FIG. 7.
Figure 9:
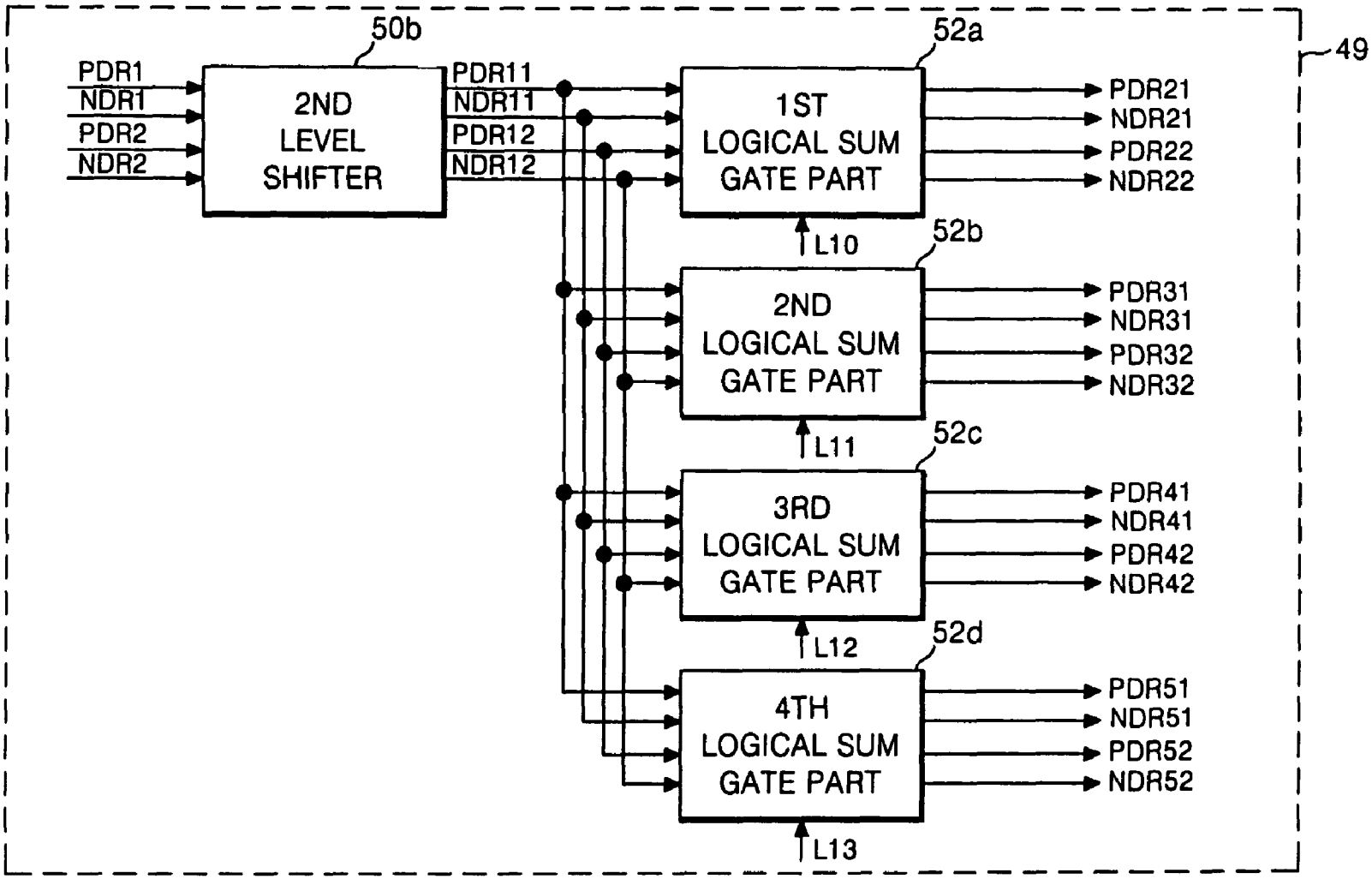
FIG. 9 is an exemplary detailed diagram of the drive signal converter shown in FIG. 7.
Figure 10A:
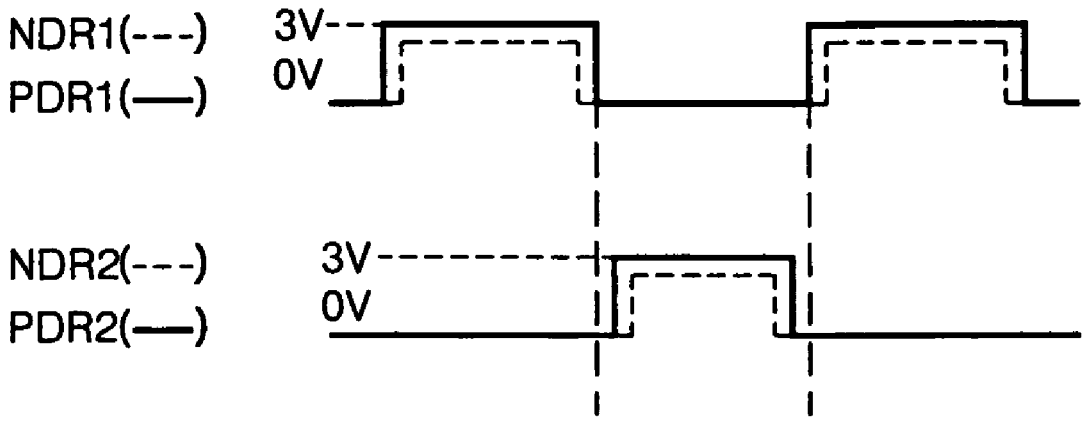
FIG. 10A is a waveform diagram representing an exemplary drive signal in the level shifter shown in FIG. 7.
Figure 10A:
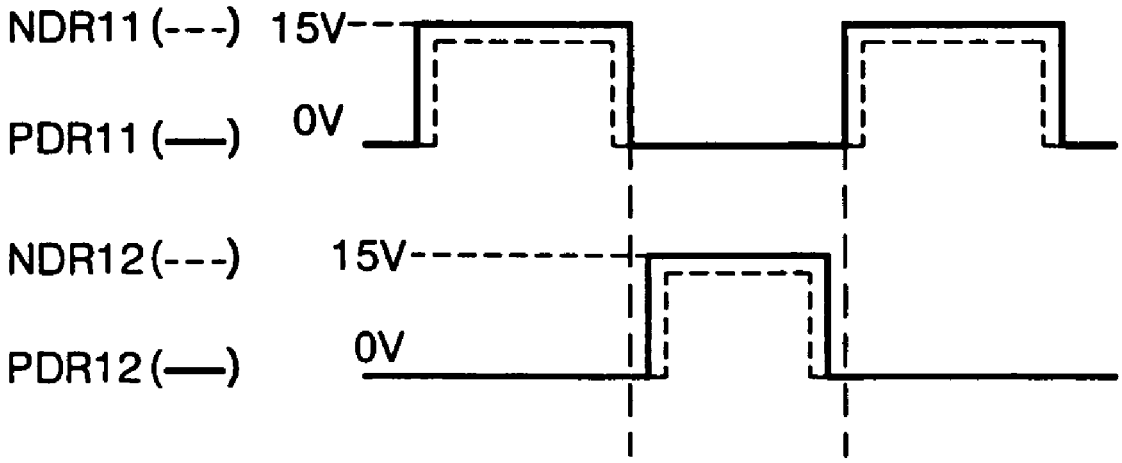
Figure 10B:
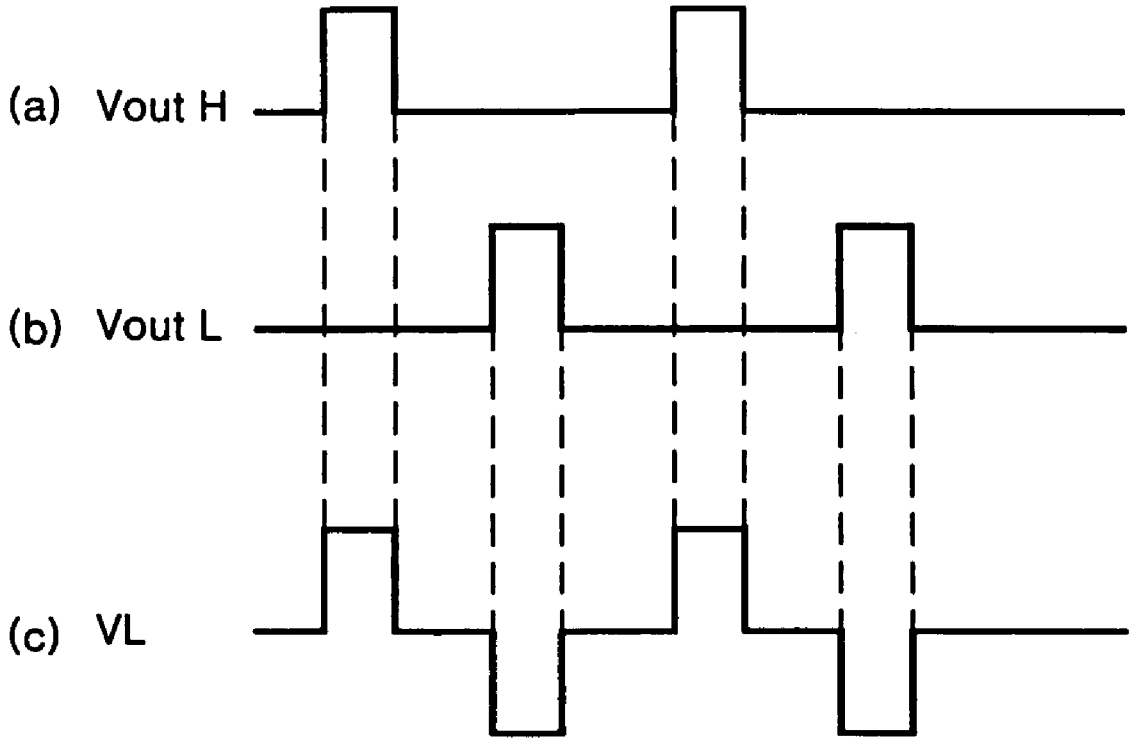
FIG. 10B is a waveform diagram representing a voltage supplied to a primary winding of a transformer by the drive signal shown in FIG. 10A.
Figure 10C:
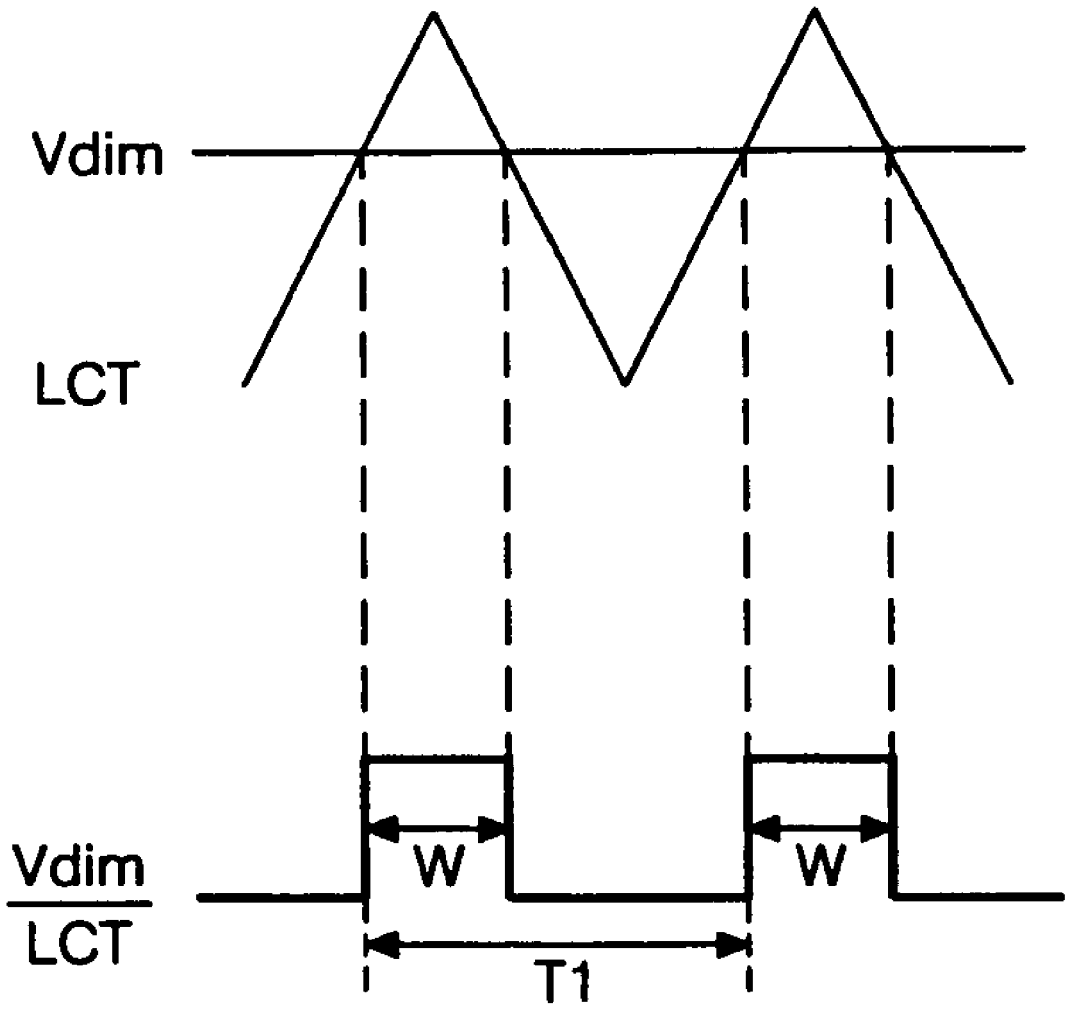
FIG. 10C is a diagram representing a method of calculating a pulse width for the dimming signals of FIG. 8.
Figure 11:
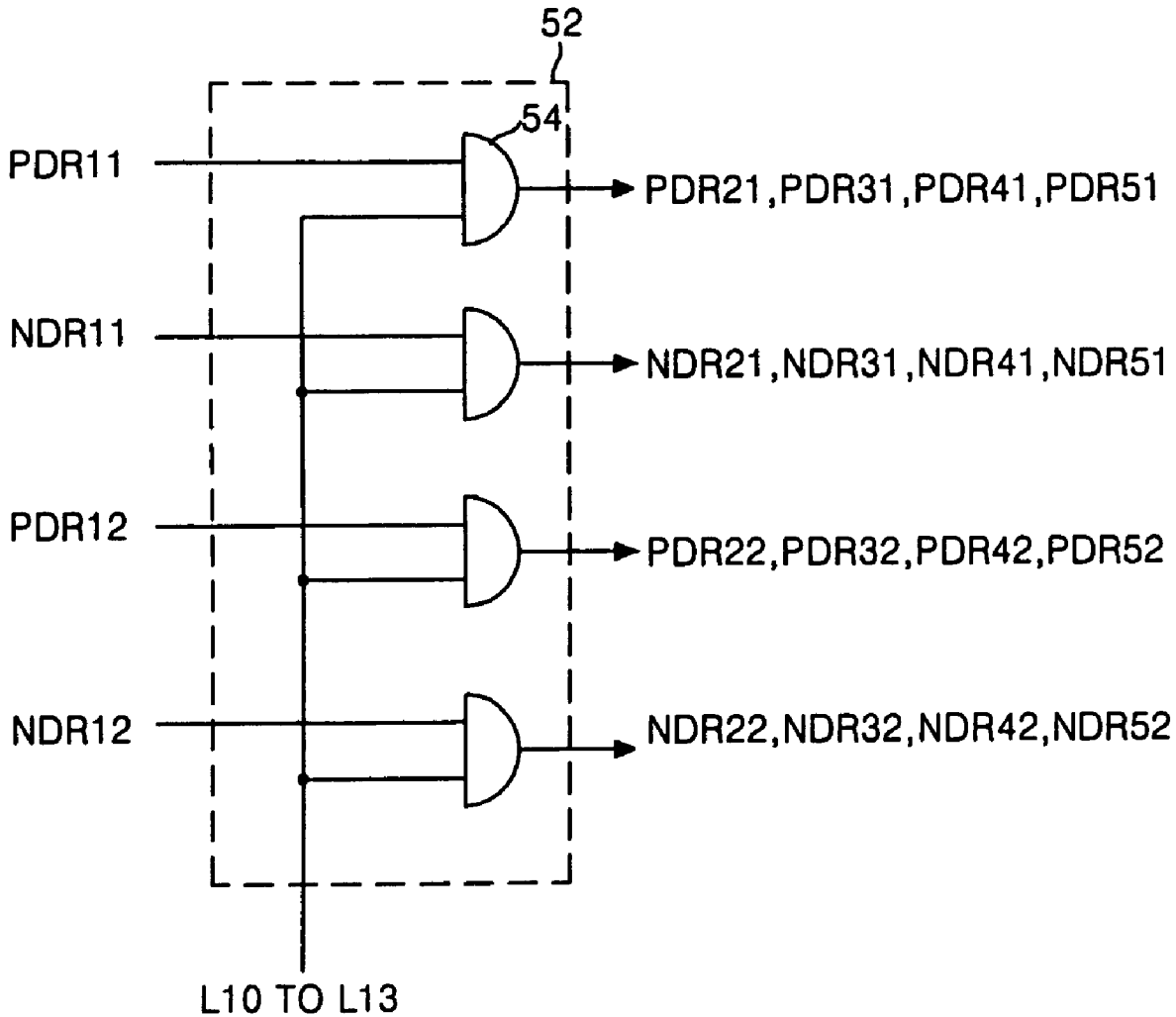
FIG. 11 is a diagram representing an exemplary logical sum gate part shown in FIG. 7.

FIG. 7 is a diagram of an exemplary lamp driving apparatus of a liquid crystal display device according to a first embodiment of the present invention. FIG. 8 is a waveform diagram representing exemplary dimming signals generated in the lamp driving apparatus of FIG. 7. FIG. 9 is an exemplary detailed diagram of the drive signal converter shown in FIG. 7. FIG. 10A is a waveform diagram representing an exemplary drive signal in the level shifter shown in FIG. 7. FIG. 10B is a waveform diagram representing a voltage supplied to a primary winding of a transformer by the drive signal shown in FIG. 10A. FIG. 10C is a diagram representing a method of calculating a pulse width for the dimming signals of FIG. 8. FIG. 11 is a diagram representing an exemplary logical sum gate part shown in FIG. 7.

Referring to FIG. 7, a lamp driving apparatus of a liquid crystal display device includes one or more lamp group 37. A plurality of lamps 36 are provided in the lamp group 37 to generate light. One or more transformer 48 supplies a high voltage AC waveform to the lamps 36. One or more switch device part 46 is switched by a drive signal to supply an externally provided DC voltage VDD to the transformer 48. An inverter 38 generates drive signals PDR1, NDR1, PDR2, and NDR2 for driving the one or more switch device part 46. An inverter controller 32 controls the inverter 38 and generates a plurality of dimming signals L0 to L3 for controlling the brightness of light generated by the lamps 36. A first level shifter 50*a* increases a voltage level of the dimming signals L0 to L3 supplied from the inverter controller 32. A drive signal converter 49 generates drive signals for driving the switch device part 46 using the drive signals PDR1, NDR1, PDR2, and NDR2 generated by the inverter 38. The dimming signals L0 to L3 are supplied from the first level shifter 50*a*.

The one or more lamp group 37 includes a plurality of lamps 36. Each of the lamps 36 receives a voltage from the transformer 48 to irradiate light onto a liquid crystal display panel (not shown). Each of the lamps 36 is formed of a glass tube with an inert gas inside. The inert gas is charged in the glass tube and a phosphorus material is spread over the inner wall of the glass tube. In each of the lamps 36, electrons are emitted to collide with the inert gas within the glass tube to increase the number of electrons according to a geometric progression when the voltage is supplied to from the transformer 48 to the high voltage electrode. The increased electrons cause an electrical current to flow in the inside of the glass tube, thus the inert gas, such as Ar or Ne, is excited by the electrons to generate an energy. The generated energy excites mercury to emit ultraviolet rays. The ultraviolet rays collide with the phosphorus material spread over the inner wall of the glass tube, thereby emitting visible rays.

The one or more transformer 48 includes a primary winding T1 which is connected by both its terminals "a" and "b" to the terminals of the switch device part 46, a first winding of secondary winding T2 which is connected on one side to one terminal of the lamp 36, and a second winding of secondary winding T3 which is connected to another terminal of the lamp 36. A high voltage AC waveform having a first phase is induced through the first winding of secondary winding T2 due to the winding ratio with the primary winding T1. A high voltage AC waveform having a second phase is induced through the second winding of secondary winding T3 due to the winding ratio with the primary winding T1.

The first winding of secondary winding T2 is connected on one side to one terminal of the lamp 36, and on another side to a feedback circuit 44 through a feedback line FB1. The second winding of secondary winding T3 is connected on one side to another terminal of the lamp 36, and on another side to the feedback circuit 44 through a feedback line FB2. The primary winding T1 converts an AC waveform supplied from the switch device 46 into a high voltage AC waveform and induces the high voltage AC waveform through the first winding of secondary winding T2 of the transformer 48 with a first phase. The primary winding T1 converts an AC waveform supplied from the switch device 46 into a high voltage AC waveform and induces the high voltage AC waveform through the second winding of secondary winding T3 of the transformer 48 with a second phase. The current supplied by the high voltage AC waveform with the first and second phases induced through the first winding of secondary winding T2 and the second winding of secondary winding T3 of the transformer 48 is supplied to each of the lamps 36. Accordingly, the lamps 36 are discharged by the supplied current to generate light.

The switch device part 46 is driven in accordance with drive signals generated by the drive signal converter 49 to supply the externally provided DC voltage VDD to the primary winding T1 of the transformer 48. The switch device part 48 includes a first switch part 46*a* to supply a positive (+) DC voltage to a first terminal "a" of the primary winding T1 of the transformer 48, and a second switch part 46*b* to supply a negative (−) DC voltage to a second terminal "b" of the primary winding T1 of the transformer 48. In this embodiment of the present invention, the number of switch device parts 46 is the same as the number of logical sum gate parts 52*a* to 52*d* (shown in FIG. 9).

The first switch part 46*a* supplies the positive (+) DC voltage VDD to the first terminal "a" of the primary winding T1 of the transformer 48. The first switch part 46*a* includes a first switch device Q1 which is installed between the first terminal "a" of the primary winding T1 of the transformer 48 and the DC voltage source VDD. The first switch device Q1 is driven by a first drive signal PDR21, PDR31, PDR41, or PDR51 which is supplied from one of the logical sum gate part 52*a* to 52*d* in the drive signal generator 49. The first switch part 46*a* includes a second switch device Q2 which is installed between the first terminal "a" of the primary winding T1 of the transformer 48 and a ground voltage GND. The second switch device Q2 is driven by a second drive signal NDR21, NDR31, NDR41, or NDR51 which is supplied from one of the logical sum gate parts 52*a* to 52*d* in the drive signal converter 49 (shown in FIG. 9). The first switch device Q1 can be a P-type transistor (MOSFET or BJT), and the second switch device Q2 can be an N-type transistor (MOSFET or BJT).

The first drive signal PDR21, PDR31, PDR41, or PDR51 and the second drive signal NDR21, NDR31, NDR41, or NDR51 of the same waveform as the first and second drive signals PDR1, NDR1, respectively, shown in FIG. 10A are supplied to the first and second switches Q1, Q2 from the first switch part 46*a*, respectively. When the first drive signal PDR21, PDR31, PDR41, or PDR51 and the second drive signal NDR21, NDR31, NDR41, or NDR51 is low, the externally provided DC voltage VDD is supplied to terminal "a" of the primary winding T1 of the transformer 48. Accordingly, as shown in waveform (a) of FIG. 10B, a first DC voltage VoutH is supplied to terminal "a" of the primary winding T1 of the transformer 48. When the first drive signal PDR21, PDR31, PDR41, or PDR51 and the second drive signal NDR21, NDR31, NDR41, or NDR51 are high, the ground voltage GND is applied to terminal "a" of the primary winding T1 of the transformer 48.

The second switch part 46*b* supplies the negative (−) DC voltage VDD to terminal "b" of the primary winding T1 of the transformer 48. The second switch part 46*b* includes a third switch device Q3 which is installed between terminal "b" of the primary winding T1 of the transformer 48 and the DC voltage source VDD. The third switch device Q3 is driven by a third drive signal PDR22, PDR32, PDR42, or PDR52 which is supplied from the a logical sum gate part 52*a* to 52*d* shown in FIG. 9. The second switch part 46*b* includes a fourth switch device Q4 installed between terminal "b" of the primary winding T1 of the transformer 48 and a ground voltage GND. The fourth switch device Q4 is driven by a fourth drive signal NDR22, NDR32, NDR42, or NDR52 supplied from the logical sum gate part 52*a* to 52*d* shown in FIG. 9. The third switch device Q3 can be a P-type transistor (MOSFET or BJT) and the fourth switch device Q4 can be an N-type transistor (MOSFET or BJT).

The third drive signal PDR22, PDR32, PDR42, or PDR52 and the fourth drive signal NDR22, NDR32, NDR42, or NDR52 having the same waveform as the third and fourth drive signals PDR2, NDR2, respectively, shown in FIG. 10A are supplied to the third and fourth switches Q3, Q4 from the second switch part 46*b*, respectively. When the third drive signal PDR22, PDR32, PDR42, or PDR52 and the fourth drive signal NDR22, NDR32, NDR42, or NDR52 are low, the externally provided DC voltage VDD is applied to terminal "b" of the primary winding T1 of the transformer 48. Accordingly, as shown in waveform (b) of FIG. 10B, a second DC voltage VoutL is supplied to terminal "b" of the primary winding T1 of the transformer 48. When the third drive signal PDR22, PDR32, PDR42, or PDR52 and the fourth drive signal NDR22, NDR32, NDR42, or NDR52 are high, the ground voltage GND is applied terminal "b" of the primary winding T1 of the transformer 48.

Thus, the first and second switch parts 46*a* and 46*b* apply a tank voltage across terminals "a" and "b" of the primary winding T1 of the transformer 48 as shown by waveform (c) in FIG. 10B. The tank voltage causes a triangular current LCT to be induced in the primary winding T1 of the transformer 48, as shown in FIG. 10C.

The inverter 38 generates drive signals PDR1, NDR1, PDR2, and NDR2 to drive the switch device part 46 using the clock signal CLK and the reference voltage Vref supplied by the inverter controller 32. The inverter 38 includes a drive signal generator 40 to generate a drive signal PDR1, NDR1, PDR2, NDR2 for driving the switch device part 46, a feedback circuit 44 connected to the transformer 48 via feedback lines FB1 to FB8 to detect the output voltage of the transformer 48, and a switch controller 42 to generate a control signal SCS for controlling the switch device part 46 based on a feedback signal FB from the feedback circuit 44.

The feedback circuit 44 generates a feedback signal FB corresponding to high voltage AC waveforms FB1 and FB2 supplied from the first winding of secondary winding T2 and the second winding of secondary winding T3 of the transformer 48. The feedback signal FB corresponding to the high voltage AC waveforms FB1 and FB2 is supplied to the switch controller 42 when the switch device part 46 is driven by the drive signals PDR21, NDR21, PDR22, and NDR22 supplied from the first logical sum gate part 52*a* (shown in FIG. 9). Further, the feedback circuit 44 generates a feedback signal FB corresponding to high voltage AC waveforms FB3 and FB4 supplied from the first winding of secondary winding T2 and the second winding of secondary winding T3 of the transformer 48. The feedback signal FB corresponding to the high voltage AC waveforms FB3 and FB4 is supplied to the switch controller 42 when the switch device part 46 is driven by the drive signals PDR31, NDR31, PDR32, and NDR32 supplied from the second logical sum gate part 52*b* (shown in FIG. 9). The feedback circuit 44 generates a feedback signal FB corresponding to high voltage AC waveforms FB5 and FB6 from the first winding of secondary winding T2 and the second winding of secondary winding T3 of the transformer 48. The feedback signal FB corresponding to high voltage AC waveforms FB5 and FB6 is supplied to the switch controller 42 when the switch device part 46 is driven by the drive signal PDR41, NDR41, PDR42, and NDR42 supplied from the third logical sum gate part 52*c*. Lastly, the feedback circuit 44 generates a feedback signal FB corresponding to high voltage AC waveforms FB7 and FB8 from the first winding of secondary winding T2 and the second winding of secondary winding T3 of the transformer 48. The feedback signal FB corresponding to high voltage AC waveforms FB7 and FB8 is supplied to the switch controller 42 when the switch device part 46 is driven by the drive signal PDR51, NDR51, PDR52, and NDR52 supplied from the fourth logical sum gate part 52*d* (shown in FIG. 9). That is, the feedback circuit 44 generates the feedback signal FB corresponding to high voltage AC waveforms FB1 and FB8 from the first winding of secondary winding T2 and the second winding of secondary winding T3 of the transformer 48 and supplies the feedback signal FB to the switch controller 42 when the switch device part 46 is driven by the drive signals supplied from one of the logical sum gate parts 52*a* to 52*d*.

The switch controller 42 generates a switching control signal SCS using a triangular wave current LCT which is induced to the primary winding T1 of the transformer 48 and a dimming voltage Vdim of DC for controlling the brightness of the lamp 36, as shown in FIG. 10C, in accordance with the feedback signal FB. Here, the dimming voltage Vdim has a value that depends on the feedback signal. Specifically, the dimming voltage Vdim moves to the lower part of the triangular wave current LCT when the brightness of the light generated at the lamp 36 is low, and the dimming voltage Vdim moves to the upper part of the triangular wave current LCT when the brightness of the light generated at the lamp 36 is high. The switching control signal SCS is supplied to the drive signal generator 40. The drive signal generator 40 generates the drive signal PDR1, NDR1, PDR2, and NDR2 for driving the switch device part 46 in accordance with the reference voltage Vref supplied from the inverter controller 32 and the switching control signal SCS supplied from the switch controller 42. The drive signal PDR1, NDR1, PDR2, and NDR2 supplied to the switch device part 46 from the drive signal generator 46 is as shown in FIG. 10A.

The inverter controller 32 receives a polarity control signal POL for controlling the polarity of dimming signals L0 to L3 from a system (not shown) to generate the dimming signals L10 to L13 for controlling the brightness of light generated by the lamp 36. The polarity of the dimming signal L0 to L3 is determined by the polarity control signal POL. Also, the inverter controller 32 generates an enable signal ENA, a clock signal CLK and a reference voltage Vref using of the polarity control signal POL. The generated enable signal ENA causes the inverter 38 to be driven, and the inverter generates the drive signal PDR1, NDR1, PDR2, NDR2 using of the clock signal and the reference voltage Vref.

The inverter controller 32 intercepts the drive of the inverter 38 if a state signal ACK which is generated when the lamp 36 malfunctions is supplied from the inverter 38. Further, the inverter controller 32, as shown in FIG. 8, supplies dimming signals L0 to L3, which is generated by an external vertical signal Vsync, to a second level shifter 50*b* of the drive signal converter 49. The width of one of the dimming signals L0 to L3 is formed by a signal having one period T1 which is formed by the triangular current LCT induced at both ends (between terminals "a" and "b") of the primary winding T1 and the dimming voltage Vdim shown in FIG. 10C.

The first level shifter 50*a* increases the voltage level of the dimming signals L0 to L3 supplied from the inverter controller 32. In other words, the first level shifter 50*a* increases the voltage level of the dimming signals to L10, L11, L12, and L13 as in wavefomn (b) of FIG. 8 if the dimming signals L0, L1, L2, and L3 from part (a) of FIG. 8 are supplied from the inverter controller 32. The voltage level of the dimming signals L0 to L3 is sustained at the same level as the drive signal PDR11, NDR11, PDR12, and NDR12. Hereby, it is possible to maintain a fan-out capability of the logical sum gate parts 52*a* to 52*d* when a logical sum is conducted in the logical sum gate part 52*a* to 52*d*.

The drive signal converter 49 converts the drive signals which are supplied to each of the switch device parts 46 using the dimming signals L10 to L13 from the first level shifter 50*a* and the drive signals PDR1, NDR1, PDR2, and NDR2 from the inverter 38. As shown in FIG. 9, the drive signal converter 49 includes a second level shifter 50*b* to increase the voltage level of the drive signal PDR1, NDR1, PDR2, and NDR2 generated by the inverter 38, and logical sum gate parts 52*a* to 52*d* to perform a logical sum of the dimming signal L10 to L13 from the first level shifter 50*a* and the drive signal PDR11, NDR11, PDR12, and NDR12 from the second level shifter 50*b*.

The second level shifter 50*b* raises the voltage level of the drive signal PDR1, NDR1, PDR2, NDR2 from the drive signal generator 40. In other words, the second level shifter 50*b* increases the low voltage of drive signals PDR1, NDR1, PDR2, and NDR2 shown in part (a) of FIG. 10 to the higher voltage of drive signal PDR1, NDR1, PDR12, and NDR12 shown in part (b) of FIG. 10. The fan-out capability of the logical sum gate parts 52*a* to 52*d* increases, thus the lamp group 37 composed of lamps 36 can be stably driven. The second level shifter 50*b* can change the voltage level of the drive signal PDR11, NDR11, PDR12, and NDR12 based on the fan-out capability of the logical sum gate parts 52*a* to 52*d*.

The logical sum gate parts 52*a* to 52*d* perform a logical sum of the drive signal PDR11, NDR11, PDR12, and NDR12, and the dimming signal L10 to L13. Each of the logical sum gate parts 52*a* to 52*d* includes a first logical sum gate part 52*a* to perform a logical sum of the first dimming signal L10 and the drive signal PDR11, NDR11, PDR12, and NDR12; a second logical sum gate part 52*b* to perform a logical sum of the second dimming signal L1 and the drive signal PDR11, NDR11, PDR12, NDR12; a third logical sum gate part 52*c* to perform a logical sum of the third dimming signal L2 and the drive signal PDR11, NDR11, PDR12, NDR12; and a fourth logical sum gate part 52*d* to perform a logical sum of the fourth dimming signal L3 and the drive signal PDR11, NDR11, PDR12, NDR12. Each of the logical sum gate part 52 is composed of a plurality of logical sum gates as shown in FIG. 11. The drive signals PDR21 to PDR51, NDR21 to NDR51, PDR22 to PDR52, NDR22 to NDR52 which are logically summed by the first to fourth logical sum gate part 52*a* to 52*d* are supplied to each of the first to fourth switch devices Q1 to Q4 of the switch device part 46. Each of the first to fourth switch devices Q1 to Q4 is driven to supply a tank voltage VL (shown in FIG. 10B) to the terminals "a" and "b" of the primary winding T1 of the transformer 48. Accordingly, the transformer 48 supplies the voltage (or current) to the lamps 36 through the first and second windings of secondary winding T2, T3.

According to the first embodiment of the present invention, the lamp driving apparatus of the liquid crystal display device utilizes four logical sum gate parts 52*a* to 52*d*, but the number of the logical sum gate parts 52*a* to 52*d* can be changed in accordance with the number of light generating lamps 36 in the liquid crystal display panel (not shown). Further, in the first embodiment of the present invention, five lamps 36 are driven by the drive signal supplied from one logical sum gate part 52*a* to 52*d*, but the number of lamps 36 driven in accordance with the fan-out capability of the logical sum gate parts 52*a* to 52*d* can be changed. Moreover, according to the first embodiment of the present invention, all the lamps 36 in the lamp driving apparatus can be driven with a single inverter 38, thus reducing the cost of the liquid crystal display device. Further, the drive signal is controlled using the dimming signal L0 to L3, thereby maintaining similar characteristics to the related art lamp driving apparatus.

Figure 12:
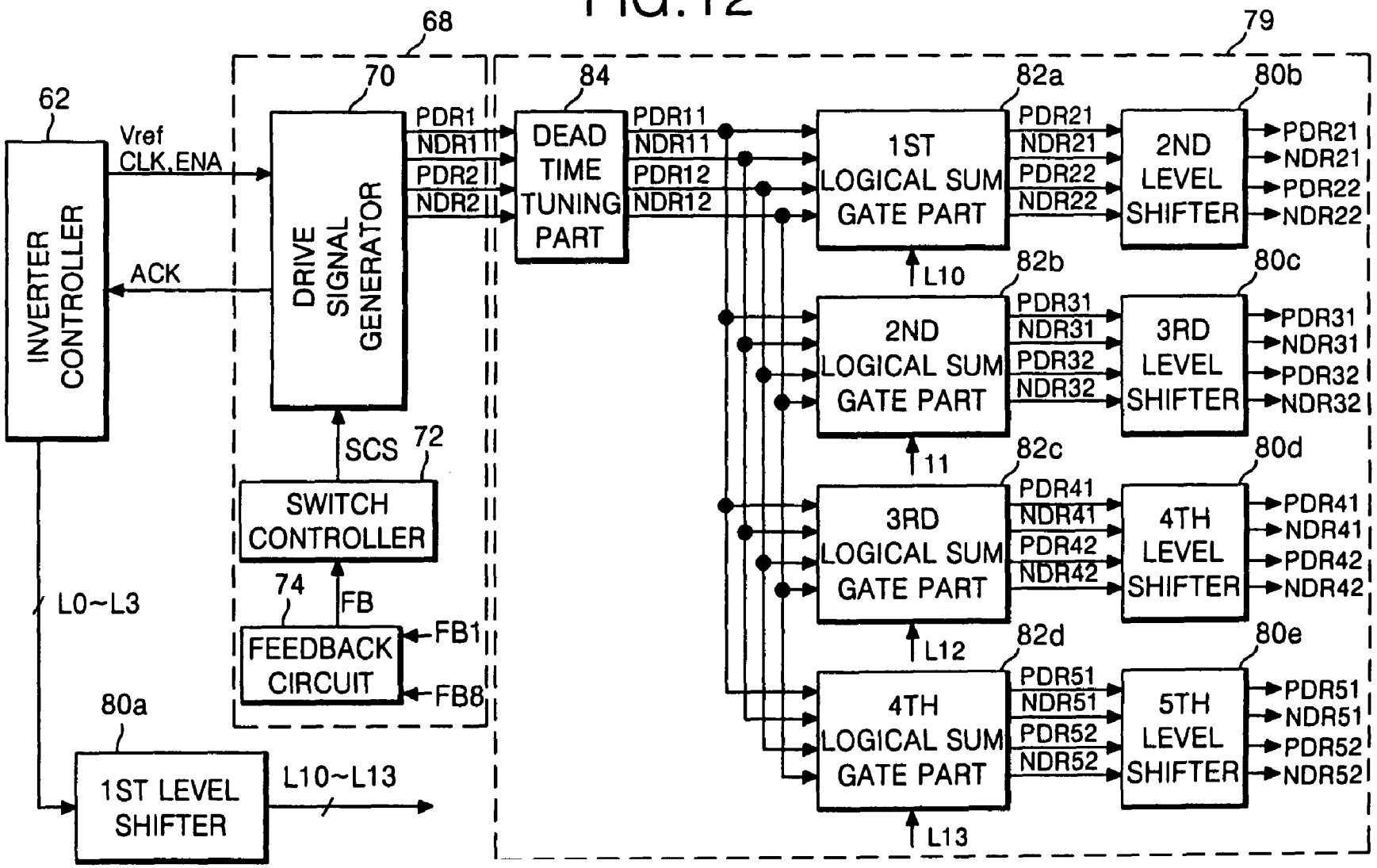
FIG. 12 is a diagram of an exemplary lamp driving apparatus of a liquid crystal display device according to a second embodiment of the present invention.
Figure 13:
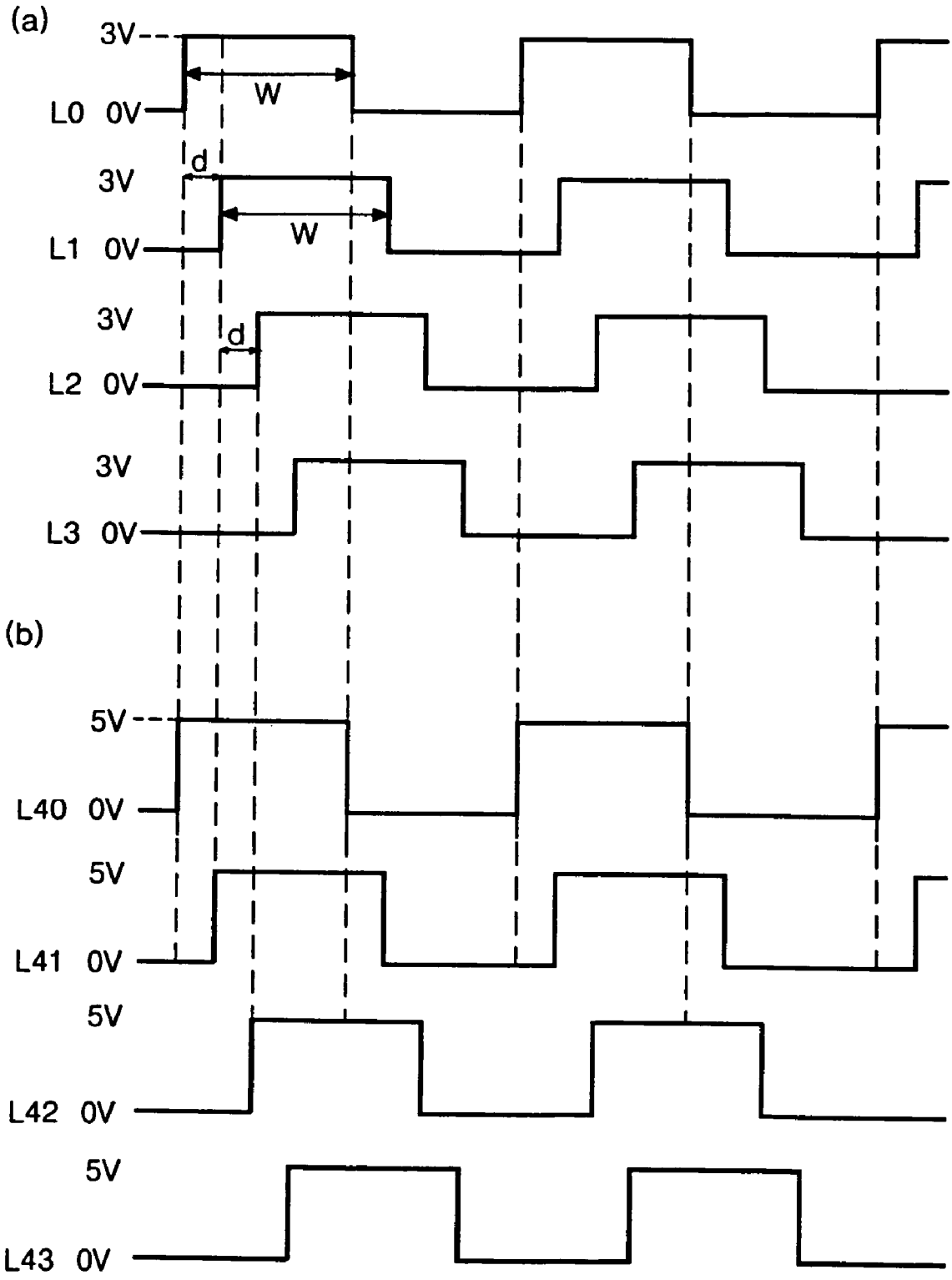
FIG. 13 is a waveform diagram representing exemplary dimming signals generated in the lamp driving apparatus of FIG. 12.
Figure 14:
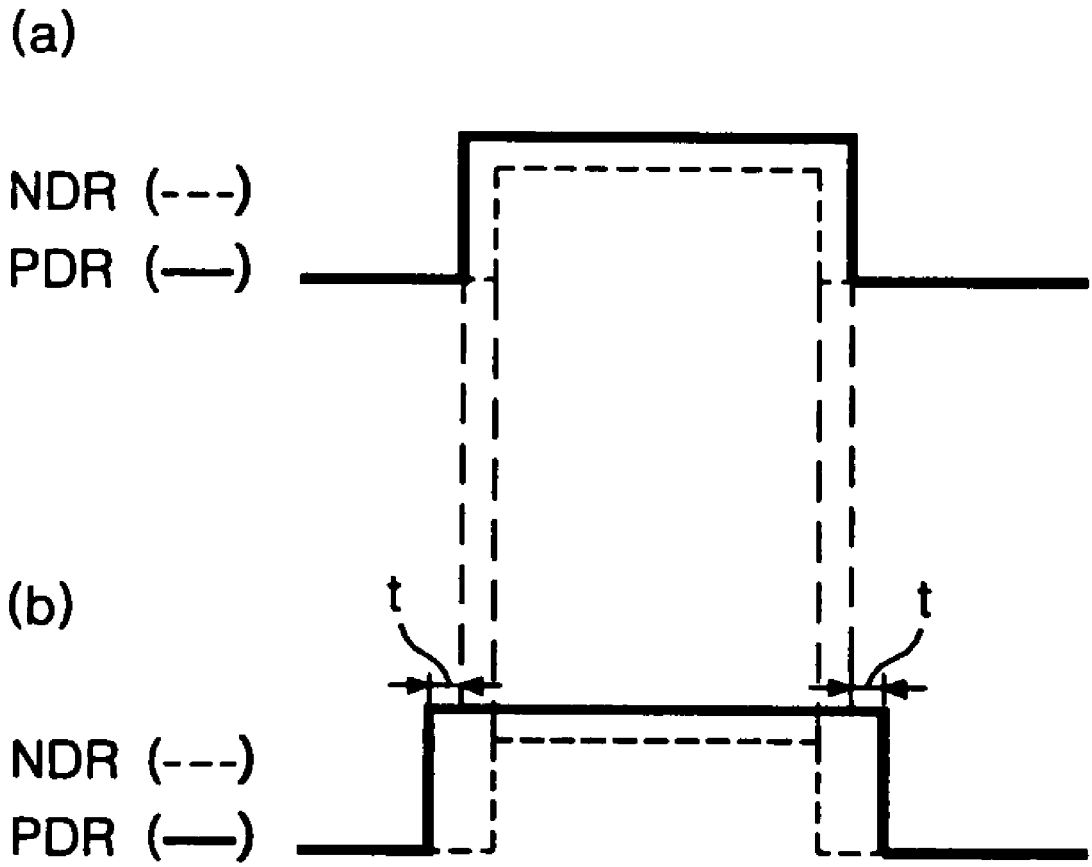
FIG. 14 is a waveform diagram representing a change of a drive signal by a dead time tuning part shown in FIG. 12.

FIG. 12 is a diagram of an exemplary lamp driving apparatus of a liquid crystal display device according to a second embodiment of the present invention. FIG. 13 is a waveform diagram representing exemplary dimming signals generated in the lamp driving apparatus of FIG. 12. FIG. 14 is a waveform diagram representing a change of a drive signal by a dead time tuning part shown in FIG. 12.

Referring to FIG. 12, the lamp driving apparatus includes an inverter 68, an inverter controller 62, a first level shifter 80*a*, and a drive signal converter 79. The inverter 68 generates drive signals PDR1, NDR1, PDR2, and NDR2 for driving the switch device part 46 (not shown). The inverter controller 62 controls the inverter 68 and generates dimming signals L0 to L3 for controlling the brightness of light generated by the lamps 36 (not shown). The first level shifter 80*a* increases a voltage level of the dimming signals L0 to L3 supplied from the inverter controller 62. The drive signal converter 79 generates drive signals for driving the switch device parts 46 (not shown) using the drive signals PDR1, NDR1, PDR2, and NDR2 that are generated by the inverter 68, and the dimming signals L0 to L3 supplied by the first level shifter 80*a*. The inverter 68 and the inverter controller 62 in the lamp driving apparatus of the liquid crystal display device according to the second embodiment of the present invention have similar structures and driving methods as discussed above with regard to the first embodiment of the present invention, thus further explanations of the inverter 68 and the inverter controller 62 will be omitted.

The first level shifter 80*a* increases the voltage level of the dimming signals L0 to L3 supplied from the inverter controller 62. In other words, the first level shifter 80*a* increases the voltage level of the dimming signals L0 to L3 provided in part (a) of FIG. 13 to generate the high voltage dimming signals L10 to L13 shown in part (b) of FIG. 13. Hereby, a fan-out capability of the logical sum gate parts 82*a* to 82*d* is improved. The dimming signals L10 to L13 and the drive signals PDR11, NDR11, PDR12, and NDR12 are maintained at the same level. The drive signals PDR11, NDR11, PDR12, and NDR12 are tuned by a dead time tuning part 84.

The drive signal converter 79 converts the drive signals to be supplied to each of the switch device parts 46 using the dimming signals L10 to L13 from the first level shifter 80*a* and the drive signals PDR1, NDR1, PDR2, and NDR2 from the inverter 68. The drive signal converter 79 includes a dead time tuning part 84, a plurality of logical sum gate parts 82*a* to 82*d*, a plurality of level shifters 80*b* to 80*e*. The dead time tuning part 84 delays a dead time of the drive signals PDR1, NDR1, PDR2, and NDR2 from the inverter 68. The logical sum gate parts 82*a* to 82*d* perform a logical sum of the drive signal from the dead time tuning part 84 and the dimming signal L0 to L3 from the first level shifter 80*a*. The level shifters 80*b* to 80*e* increase the voltage level of the drive signals PDR21 to PDR51, NDR21 to NDR51, PDR2 to PDR52, NDR2 to NDR52 that are logically summed by the logical sum gate part 82*a* to 82*d*.

The dead time tuning part 84 delays the dead time of the drive signal PDR1, NDR1, PDR2, NDR2 which is generated at the drive signal generator 70. In other words, the dead time tuning part 84 generates delayed drive signals PDR, NDR, as shown in part (b) of FIG. 14, by delaying the drive signals NDR and PDR provided in part (a) of FIG. 14 up to a specified time "t" for stably driving the switch device part 46.

The logical sum gate parts 82*a* to 82*d* perform a logical sum of the drive signal PDR11, NDR11, PDR12, and NDR12 from the dead time tuning part 84, and the dimming signals L10 to L13 from the first level shifter 80*a*. The first logical sum gate part 82*a* performs logical sum of the first dimming signal L10 and the drive signals PDR11, NDR11, PDR12, and NDR12. The second logical sum gate part 82*b* performs a logical sum of the second dimming signal L1 and the drive signals PDR11, NDR11, PDR12, and NDR12. The third logical sum gate part 82*c* performs a logical sum of the third dimming signal L12 and the drive signals PDR11, NDR11, PDR12, and NDR12. The fourth logical sum gate part 82*d* performs a logical sum of the fourth dimming signal L13 and the drive signals PDR11, NDR11, PDR12, and NDR12. Each of the logical sum gate parts 82*a* to 82*d* includes a plurality of logical sum gates 54 as shown in FIG. 11. The drive signals PDR21 to PDR51, NDR21 to NDR51, PDR22 to PDR52, NDR22 to NDR52 that are logically summed by the first to fourth logical sum gate parts 82*a* to 82*d* are supplied to each of the second to fifth switch level shifters 80*b* to 80*e*.

The level shifters 80*b* to 80*e* receive the drive signals PDR21 to PDR51, NDR21 to NDR51, PDR22 to PDR52, NDR22 to NDR52 logically summed by the first to fourth logical sum gate part 82*a* to 82*d* and increase the voltage level of the drive signals PDR21 to PDR51, NDR21 to NDR51, PDR2 to PDR52, NDR22 to NDR52. The second level shifter increases the voltage level of the drive signals PDR21, PDR21, PDR22, and NDR22 from the first logical sum gate part 82*a*. The third level shifter increases the voltage level of the drive signals PDR31, PDR31, PDR32, and NDR32 from the second logical sum gate part 82*b*. The fourth level shifter increases the voltage level of the drive signals PDR41, PDR41, PDR22, and NDR22 from the third logical sum gate part 82*c*. The fifth level shifter increases the voltage level of the drive signal PDR21, PDR21, PDR22, and NDR22 from the fourth logical sum gate part 82*d*. The switch device 46 (not shown) is driven stably because the level of the supplied drive signals PDR21 to PDR51, NDR21 to NDR51, PDR22 to PDR52, NDR22 to NDR52 is increased by the second to fifth level shifters 80*b* to 80*e*.

According to the second embodiment of the present invention, the voltage level of the drive signal PDR21 to PDR51, NDR21 to NDR51, PDR22 to PDR52, NDR22 to NDR52 is increased using four level shifters 80*b* to 80*e* to correspond to four logical sum gate parts 82*a* to 82*d*, but the number of level shifters 80*b* to 80*e* and logical sum gate parts 82*a* to 82*d* can be changed in accordance with the number of light generating lamps 36 in the liquid crystal display panel (not shown). Further, the number of the lamps 36 to be driven can also be changed in accordance with the fan-out capability of the logical sum gate parts 82*a* to 82*d*. The lamp driving apparatus according to the second embodiment of the present invention can drive all the lamps 36 with one inverter 68. Further, the drive signals being controlled using the dimming signal L0 to L3 can maintain the same characteristics as the lamp driving apparatus of the related art liquid crystal display device.

Figure 15:
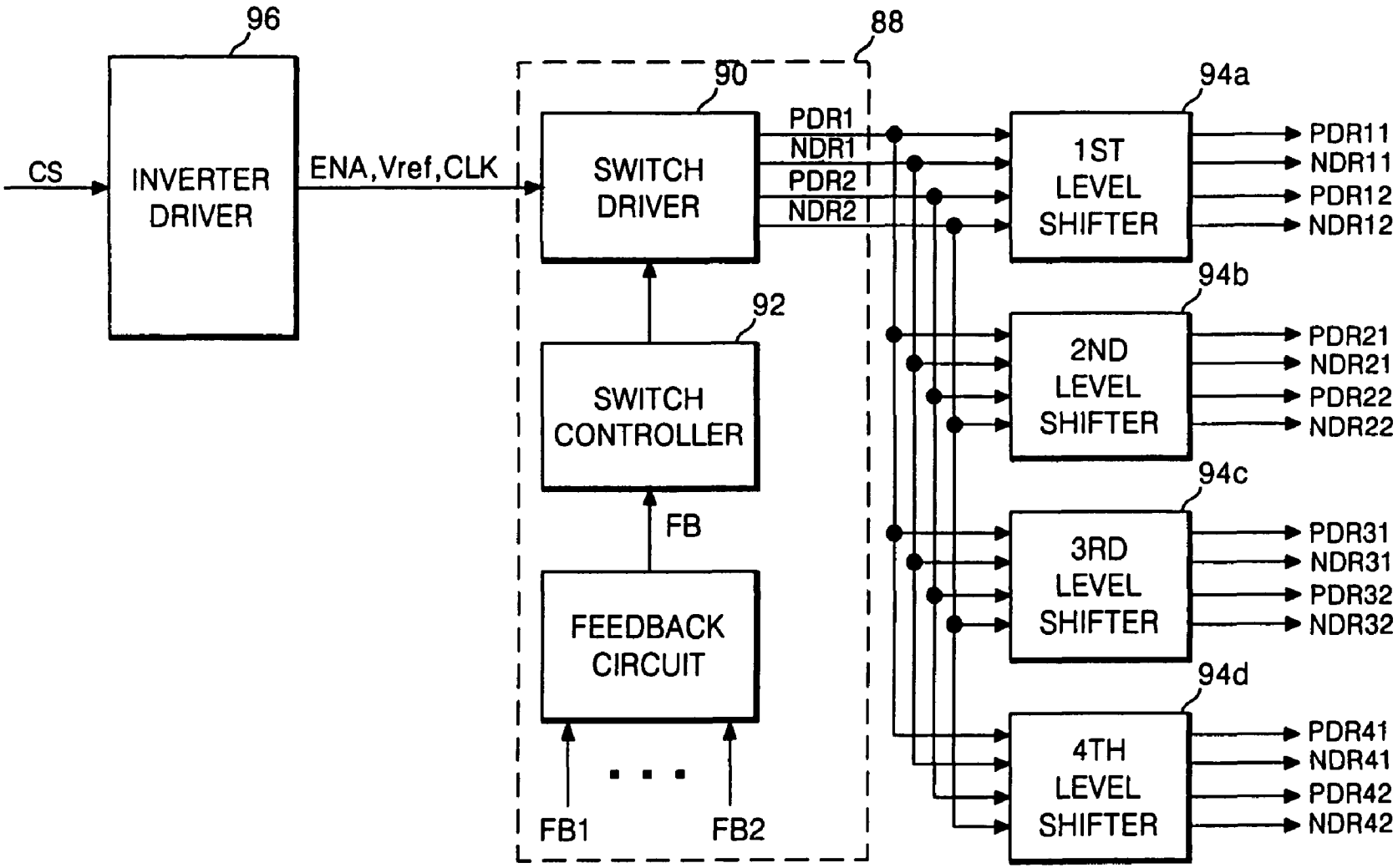
FIG. 15 is a diagram of an exemplary lamp driving apparatus of a liquid crystal display device according to a third embodiment of the present invention.

FIG. 15 is a diagram of an exemplary lamp driving apparatus of a liquid crystal display device according to a third embodiment of the present invention. Referring to FIG. 15, the lamp driving apparatus includes an inverter 88, an inverter driver 96, and a plurality of level shifters 94*a* to 94*d*. The inverter 88 generates drive signals PDR1, NDR1, PDR2, and NDR2 for driving the switch device part 46 (not shown). The inverter driver 96 drives the inverter 88 and supplies a clock signal CLK and a reference voltage Vref to the inverter 88 for generating the drive signals PDR1, NDR1, PDR2, and NDR2. The level shifters 94*a* to 94*d* raise the voltage level of the drive signals PDR1, NDR1, PDR2, and NDR2 from the inverter 88. The inverter 88 in the lamp driving apparatus of the liquid crystal display device according to the third embodiment of the present invention have similar structures and driving methods as discussed above with regard to the first embodiment of the present invention, thus further explanations of the inverter 88 will be omitted.

The inverter driver 96 receives a control signal CS from a system (not shown) and supplies an enable signal ENA to drive the inverter 88, a clock signal CLK to generate the drive signals PDR1, NDR1, PDR2, and NDR2, and a reference voltage Vref. The inverter 88 uses the clock signal CLK and the reference voltage Vref to generate the drive signals PDR1, NDR1, PDR2, and NDR2.

The level shifters 94*a* to 94*d* raise the voltage level of the drive signals PDR1, NDR1, PDR2, and NDR2 from the drive signal generator 90. The voltage level of the drive signals PDR1, NDR1, PDR2, and NDR2 converted by the level shifters 94*a* to 94*d* is illustrated in part (b) of FIG. 10. The level shifters 94*a* to 94*d* supply the drive signals to the plurality of switch device parts. The number of level shifters 94*a* to 94*d* corresponds to the number of switch device parts. For example, as shown in FIG. 15, four level shifters 94*a* to 94*d* are provided for driving four switch device parts. The drive signals PDR11 to PDR41, NDR11 to NDR41, PDR12 to PDR42, NDR12 to NDR42 are respectively supplied to each of the switch device parts 46. Thus, a tank voltage is applied at the terminals of the primary winding T1 of the transformer 48. Accordingly, the voltage (or current) is induced in the first and second windings of secondary winding T2, T3 of the transformer to drive the lamps 46.

In the lamp driving apparatus of the liquid crystal display device according to the third embodiment of the present invention, four level shifters 94*a* to 94*d* are used to raise the voltage level of the drive signals PDR11 to PDR41, NDR11 to NDR41, PDR12 to PDR42, NDR12 to NDR42. However, the number of level shifters can be changed in accordance with the number of light generating lamps 36 in the liquid crystal display panel (not shown). In the lamp driving apparatus of the liquid crystal display device according to the third embodiment of the present invention, all the lamps 46 can be driven with one inverter, thereby reducing the cost of the liquid crystal display device.

As described above, in embodiments of the present invention, one inverter is used to drive all the lamps in the lamp driving apparatus, thereby reducing the cost of the liquid crystal display device.

It will be apparent to those skilled in the art that various modifications and variations can be made in the apparatus and method of driving lamp of liquid crystal display device of the present invention without departing from the spirit or scope of the invention. Thus, it is intended that the present invention cover the modifications and variations of this invention provided they come within the scope of the appended claims and their equivalents.

What is claimed is:

1. A lamp driving apparatus of a liquid crystal display device, comprising:

a plurality of lamps;

a polarity signal generator generating a polarity signal;

an inverter generating a first drive signal;

an inverter controller driving the inverter and generating a first dimming signal, the polarity of the first dimming signal being determined by the polarity signal;

a first level shifter generating a second dimming signal by shifting a voltage level of the first dimming signal;

a dead time tuning part generating a second drive signal by delaying a dead time of the first drive signal;

a plurality of logical sum gate parts, each of the plurality of logical sum gate parts generating a third drive signal by performing a logical sum of the second dimming signal and the second drive signal;

a level shifter part generating a fourth drive signal by shifting a voltage level of the third drive signal;

a plurality of switch device parts, each of the plurality of switch device parts receiving a high potential supply voltage and a low potential supply voltage and selectively outputting one of the high potential supply voltage and the low potential supply voltage in response to the fourth drive signal; and a plurality of transformers, each of the plurality of transformers transforming the selectively outputted voltage of the switch device parts and supplying the transformed voltage to the lamps.

2. The lamp driving apparatus according to claim 1, wherein each of the logical sum gate parts includes a plurality of logical sum gates to logically sum the second drive signal and the second dimming signal.

3. The lamp driving apparatus according to claim 2, wherein the level shifter part includes a plurality of level shifters which correspond to the switch device parts, respectively.

4. The lamp driving apparatus according to claim 3, wherein the level shifters correspond to the logical sum gate parts, respectively.

5. A method of driving a lamp of a liquid crystal display device, comprising the steps of:

generating a polarity signal;

generating a first drive signal in response to the polarity signal;

generating a first dimming signal, the polarity of the first dimming signal being determined by the polarity signal;

generating a second dimming signal by shifting a voltage level of the first dimming signal;

generating a second drive signal by delaying a dead time of the first drive signal;

generating a third drive signal by logically summing the second dimming signal and the second drive signal;

generating a fourth drive signal by shifting a voltage level of the third drive signal;

selectively outputting one of a high potential supply voltage and a low potential supply voltage in response to the third drive signal;

transforming the selectively outputted voltage; and supplying the transformed voltage to a lamp.

6. The method of claim 5, wherein the step of generating the second dimming signal includes increasing a voltage level of the first dimming signal.

7. The method of claim 6, wherein the step of generating the fourth drive signal includes increasing a voltage level of the third drive signal.

* * * * *